US007695898B2

(12) United States Patent
Ishihara

(10) Patent No.: US 7,695,898 B2
(45) Date of Patent: Apr. 13, 2010

(54) PHOTOTHERMOGRAPHIC MATERIAL AND IMAGE FORMATION METHOD

(75) Inventor: Makoto Ishihara, Minami-ashigara (JP)

(73) Assignee: Fujifilm Corporation, Tokyo (JP)

( * ) Notice: Subject to any disclaimer, the term of this patent is extended or adjusted under 35 U.S.C. 154(b) by 5 days.

(21) Appl. No.: 12/101,032

(22) Filed: Apr. 10, 2008

(65) Prior Publication Data

US 2009/0123881 A1 May 14, 2009

Related U.S. Application Data

(62) Division of application No. 10/209,922, filed on Aug. 2, 2002, now abandoned.

(30) Foreign Application Priority Data

Aug. 2, 2001 (JP) ..... 2001-234339

(51) Int. Cl.
*G03C 5/00* (2006.01)
*G03C 1/498* (2006.01)

(52) U.S. Cl. ..... 430/350; 430/523; 430/619; 430/623; 430/624; 430/625; 430/961; 430/958

(58) Field of Classification Search ..... 430/619, 430/624, 625, 623, 523, 961, 958, 350
See application file for complete search history.

(56) References Cited

U.S. PATENT DOCUMENTS 4,359,524 A * 11/1982 Masuda et al. ..... 430/522
5,469,238 A * 11/1995 Biegler ..... 396/565
5,496,695 A 3/1996 Simpson et al.
5,958,668 A 9/1999 Matsumoto et al.
6,297,001 B1 10/2001 Takiguchi et al.
6,468,725 B2 10/2002 Takamuki et al.
6,566,042 B1 5/2003 Goto et al.

FOREIGN PATENT DOCUMENTS

EP 1096310 * 5/2001
JP 2001-83653 A 3/2001
JP 2001-092079 4/2001
JP 2001-133924 A 5/2001
JP 2001-154309 A 6/2001

OTHER PUBLICATIONS

Polymer Data Handbook, Edited by J.E. Mark, 1999, p. 49, Oxford University Press.
Instruction manual for the scanning electron microscope S-3200N of Hitachi, Ltd. published in 1995.

* cited by examiner

*Primary Examiner*—Thorl Chea
(74) *Attorney, Agent, or Firm*—Birch, Stewart, Kolasch & Birch, LLP

(57) ABSTRACT

Disclosed is a photothermographic material having an image-forming layer containing a silver salt of an organic acid, photosensitive silver halide grains and a reducing agent on a support, wherein ratio of scratch strength measured before heat development and scratch strength measured 30 minutes after the heat development is in the range of 1:1-1:3 for a surface of the image-forming layer side. The photothermographic material shows improved film strength after heat development.

23 Claims, 1 Drawing Sheet

PHOTOTHERMOGRAPHIC MATERIAL AND IMAGE FORMATION METHOD

This application is a Divisional of co-pending application Ser. No. 10/209,922, filed on Aug. 2, 2002, the entire contents of which are hereby incorporated by reference and for which priority is claimed under 35 U.S.C. §120.

TECHNICAL FIELD

The present invention relates to a photothermographic material and a method for forming an image by utilizing it. In particular, the present invention relates to a photothermographic material for image setters suitable for photomechanical processes, more precisely, a photothermographic material that shows an improved physical property of film after heat development.

RELATED ART

In the field of platemaking for printing, waste solutions generated with wet processing of image-forming materials have conventionally caused a problem concerning workability, and in recent years, it is strongly desired to reduce the amount of the processing waste solutions also from the standpoints of environmental protection and space saving. Therefore, techniques relating to photothermographic materials that can be efficiently exposed by using image setters and form clear black images with high resolution have been noted.

As such techniques, there have been known, for example, photothermographic materials containing a silver salt of an organic acid, photosensitive silver halide grains, a reducing agent and a binder on a support, as described in U.S. Pat. Nos. 3,152,904, 3,457,075, D. Morgan, "Dry Silver Photographic Materials" in Handbook of Imaging Materials, Marcel Dekker, Inc., page 48, 1991 and so forth.

For use in photomechanical processes for printing, a substantially colorless photosensitive material, in particular, a photosensitive material colorless for the NV region is required. In a photosensitive material for which exposure with an infrared ray is intended, absorption of sensitizing dyes and antihalation dyes in the visible region can be markedly reduced and hence a substantially colorless photosensitive material can easily be produced. Thus, techniques of infrared sensitive photothermographic silver halide photographic materials have been developed. Spectral sensitization techniques are disclosed in Japanese Patent Publication (Kokoku, hereinafter referred to as JP-B) No. 3-10391, JP-B-6-52387, Japanese Patent Laid-open Publication (Kokai, henceforth referred to as JP-A) No. 5-341432, JP-A-6-194781, JP-A-6-301141 and so forth, and antihalation techniques are disclosed in JP-A-7-13295, U.S. Pat. No. 5,380,635 and so forth.

In recent years, digitalization and automatization of operations have been popularized for the whole printing process steps, and a CTF (Computer To Film) system has been becoming a main stream of photomechanical process, in which information is compiled on a computer (DTP, Desk Top Publishing) and the compiled digital information is directly outputted on a film. Usually, the outputted film is immediately transferred to the platemaking process by setting it on an automatic platemaking machine. Therefore, not only the film is required to have film strength during transportation (before heat development) in a plotter (light exposure apparatus) and a heat development apparatus (processor), but also the outputted film is required to have film strength so as not to cause problems during the platemaking process. However, it was found that conventional photothermographic materials might show insufficient film strength for the image-forming layer side after heat development, and cause problems such as generation of scratches on formed images.

Accordingly, it has been desired to develop a photothermographic material showing improved film strength after heat development.

SUMMARY OF THE INVENTION

Therefore, an object of the present invention is to provide a photothermographic material for photomechanical processes showing improved film strength after heat development, in particular, for scanners and image setters, and an image formation method utilizing it.

The inventor of the present invention assiduously studied in order to achieve the aforementioned object, and as a result, he found that a superior photothermographic material could be obtained by controlling scratch strength of image-forming layer side before and after heat development.

That is, the present invention provides a photothermographic material having an image-forming layer containing a silver salt of an organic acid, photosensitive silver halide grains and a reducing agent on a support, wherein ratio of scratch strength measured before heat development and scratch strength measured 30 minutes after the heat development is in the range of 1:1-1:3, preferably 1:2-1:3, for a surface of the image-forming layer side.

The photothermographic material of the present invention preferably has at least one non-photosensitive layer on the image-forming layer, and the non-photosensitive layer preferably contains an inorganic matting agent. Further, the transparent support is preferably subjected to a heat treatment, and preferably has a thickness of 110-140 μm, in particular, 110-125 μm. The photothermographic material of the present invention preferably contains a high contrast agent. Furthermore, the non-photosensitive layer on the image-forming layer side preferably has a thickness of 2-5 μm, and any one of constitutive layers on the image-forming layer side preferably contains at least one compound selected from the group consisting of aziridine compounds, epoxy compounds and carbodiimide compounds.

The present invention also provides a method for forming an image, which comprises exposing and developing the aforementioned photothermographic material by using an on-line system including a plotter, a heat development apparatus provided with a pre-heating section, a heat development section, a gradual cooling section and a deodorizing apparatus and an auto carrier connecting the plotter and the heat development apparatus and automatically transporting the photothermographic material from the plotter to the heat development apparatus. In the image formation method of the present invention, processing speed of the auto carrier ($t_1$), processing speed of the pre-heating section of the heat development apparatus ($t_2$) and processing speed of the heat development section of the heat development apparatus ($t_3$) in the on-line system preferably satisfy the following relationship:

$$t_3 > t_2 \geqq t_1$$

Further, the processing speed of the heat development section is preferably 21-100 mm/second, particularly preferably 27-50 mm/second. Furthermore, light source for light exposure of the plotter is preferably a laser of a wavelength of 750-800 nm, and main scanning speed on a surface of the photothermographic material is preferably 500-1500 m/second, particularly preferably 1100-1500 m/second.

According to the present invention, there can be provided a photothermographic material showing improved film strength after heat development and having superior properties for subsequent processing, i.e., not generating image defects or printing blurs on a PS plate. Therefore, according to the present invention, there can be obtained a photothermographic material suitable for use in photomechanical processes.

BEST MODE FOR CARRYING OUT THE INVENTION

Figure 1:
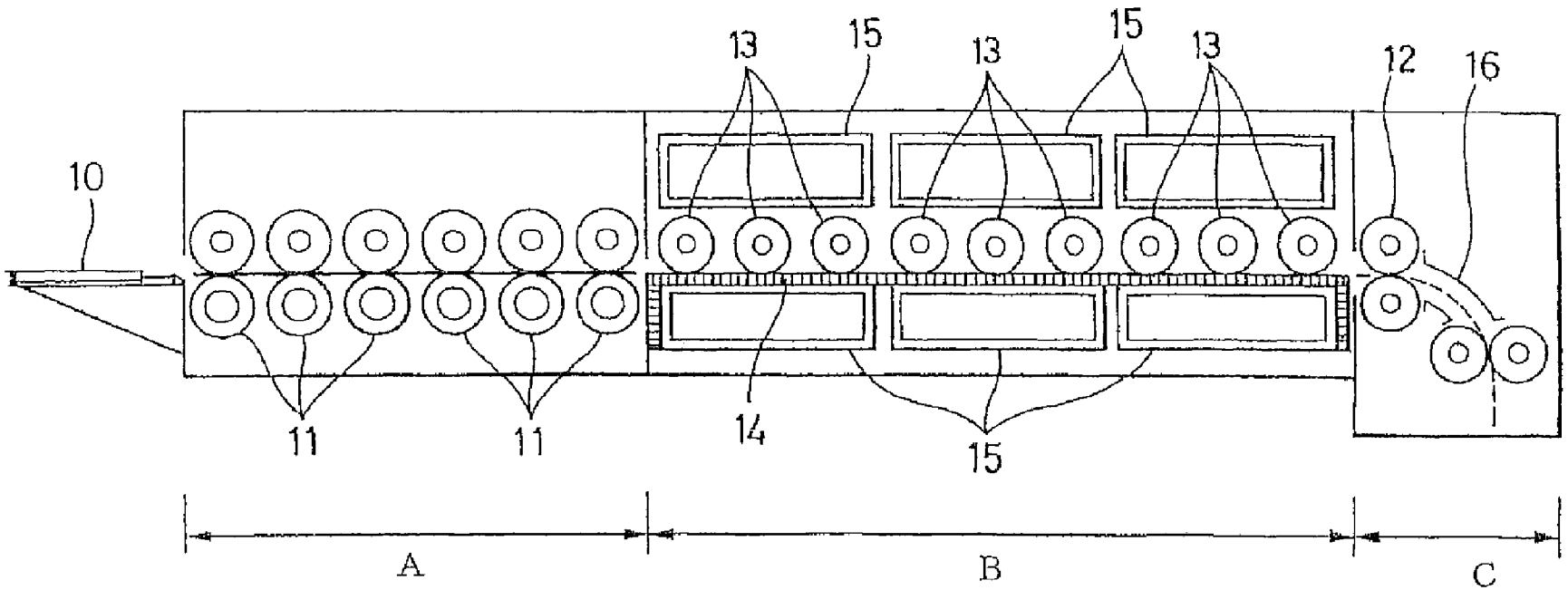
FIG. 1 is a side view of an exemplary heat development apparatus used for heat development of the photothermographic material of the present invention. In the FIGURE, there are shown a photothermographic material 10, carrying-in roller pairs 11, taking-out roller pairs 12, rollers 13, a flat surface 14, heaters 15, and guide panels 16. The apparatus consists of a preheating section A, a heat development section B, and a gradual cooling section C.

The photothermographic material and image formation method of the present invention will be explained in detail hereafter. In the following description, ranges indicated with "–" mean ranges including the numerical values before and after "–" as the minimum and maximum values.

The present invention is characterized in that, for the image-forming layer surface of the photothermographic material, ratio of scratch strength measured before heat development and scratch strength measured 30 minutes after the heat development is in the range of 1:1-1:3. In the present specification, "scratch strength" means, when load continuously increasing from 0 to 300 g is applied to an image-forming layer side surface of the photothermographic material after heat development through a sapphire needle having a tip end curvature radius of 0.1 mm by using a scratch meter, HEIDON Model 18L, manufactured by Shinto Kagaku Co., Ltd., a load at which a scratch begins to be generated on the surface. In the present invention, the ratio of scratch strength measured before heat development and scratch strength measured 30 minutes after the top end of the film begins to be transported out of the heat development apparatus is preferably in the range of 1:1-1:3, more preferably 1:2-1:3. Further, while a larger value of the scratch strength is more preferred from the viewpoint of scratch resistance, it is preferably in the range of 80-300 g, more preferably 100-300 g, as measured by the aforementioned measurement method before heat development. In order to surely obtain the effect of the present invention, the value of scratch strength is preferably 80 g or more before heat development. As for environmental conditions for taking out the photothermographic material from the heat development apparatus, conditions of 24° C. and relative humidity of 50% are employed.

The photothermographic material of the present invention has at least one photosensitive layer on a support. The photosensitive layer may consist of multiple layers, or may consist of a combination of a high sensitivity layer and a low sensitivity layer in order to control gradation. While the photothermographic material of the present invention may have only the photosensitive layer on the support, it preferably has at least one non-photosensitive layer on the photosensitive layer. In the present invention, the photosensitive layer preferably has a thickness of 12-17 μm. The non-photosensitive layer, i.e., a protective layer, has a thickness of preferably 2-5 μm, more preferably 2.3-4.0 μm. As for the thickness of the protective layer, in particular, a thickness less than 2 μm invites low film strength after heat development and a tendency that the scratch resistance becomes problematic. On the other hand, if it exceeds 5 μm, there is required a long period of time until film strength of a film transported out of the apparatus after the heat treatment according to the present invention is stabilized, or reduction of sensitivity tends to be caused as for photographic performance.

In order to achieve the object of the present invention, at least one of the image-forming layer and the non-photosensitive layer preferably contains at least one hardening agent selected from the group consisting of aziridine compounds such as those described in U.S. Pat. No. 3,017,280 and JP-A-9-5916, epoxy compounds such as those described in U.S. Pat. No. 3,017,280 and JP-A-9-5916 and carbodiimide compounds such as those described in U.S. Pat. No. 3,100,704.

First, compounds having an aziridine group that can be used for the present invention will be explained. In the present invention, although any compounds having an aziridine group and showing film-hardening action may be used, the compounds specifically mentioned below can be preferably used for practice of the present invention.

AZ-1

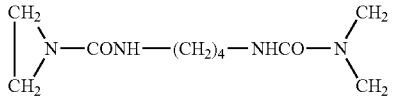

AZ-2

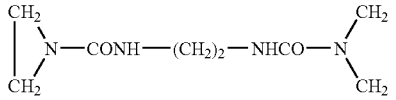

AZ-3

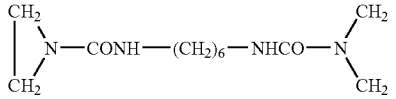

AZ-4

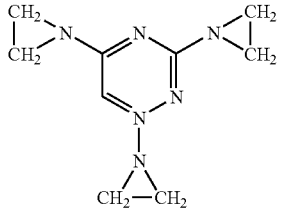

Hereafter, epoxy type hardening agents that can be used for the present invention will be explained. In the present invention, although any compounds having an epoxy group and showing film-hardening action may be used, epoxy type compounds containing a hydroxy group or ether condensation are preferred. Such compounds are specifically mentioned below.

EP-1
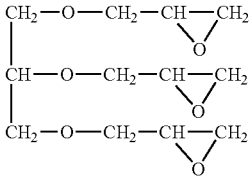
EP-2
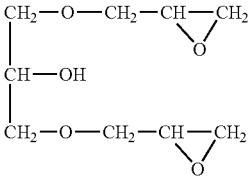
EP-3
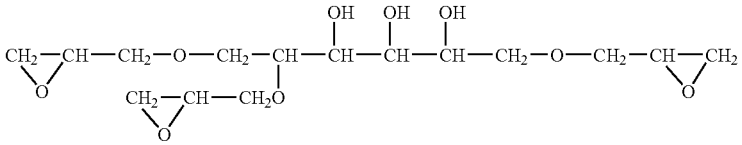
EP-4
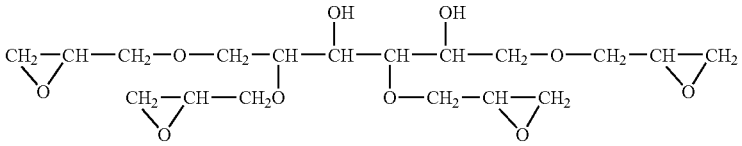
EP-5
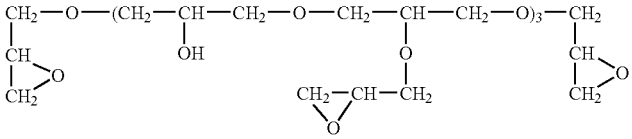
EP-6
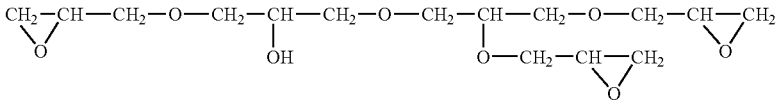
EP-7
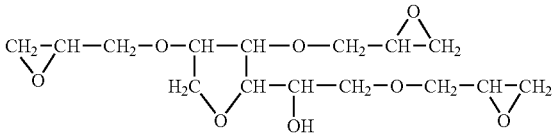
EP-8
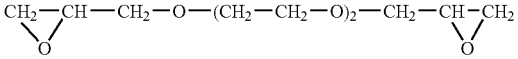
EP-9
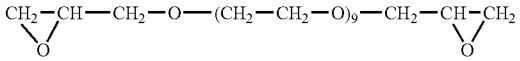
EP-10
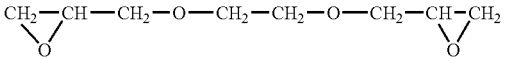
EP-11
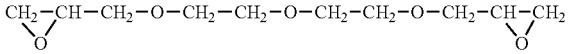
EP-12
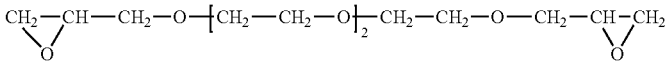
EP-13
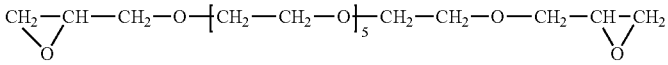
EP-14
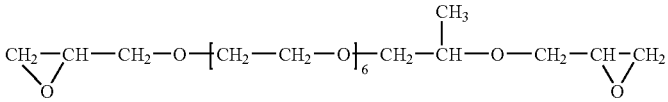
EP-15
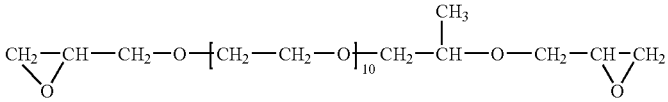

-continued
EP-16
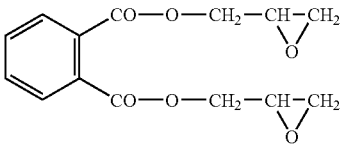
EP-17
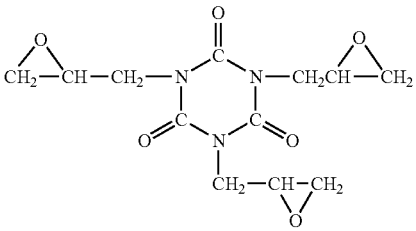
EP-18
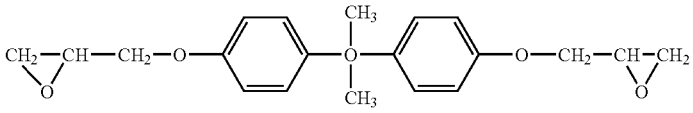
EP-19
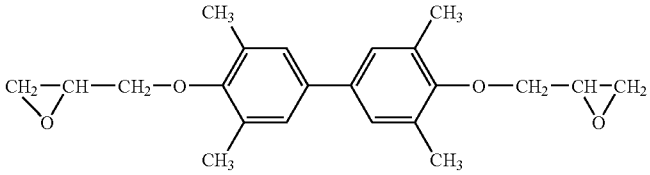
EP-20
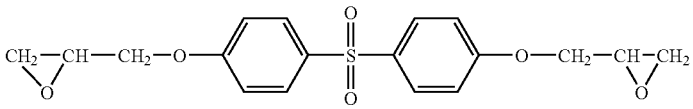
EP-21
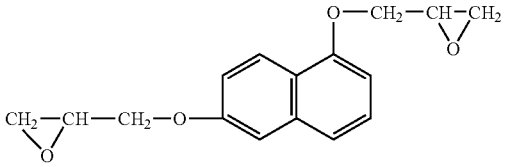
EP-22
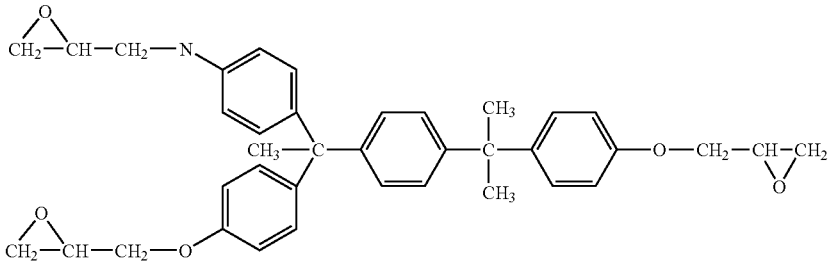
EP-23
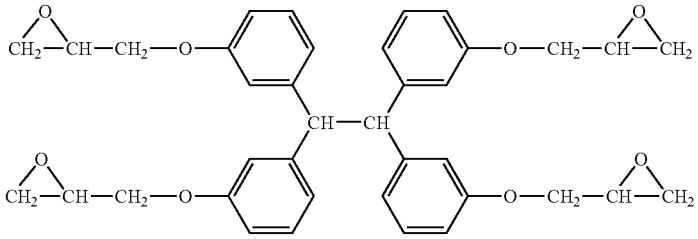
EP-24
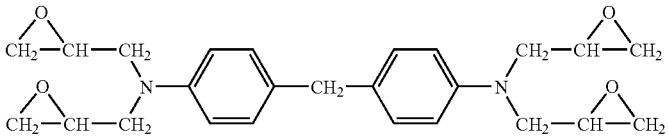

-continued

EP-25

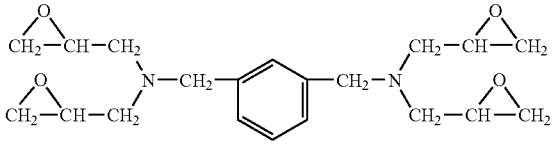

EP-26

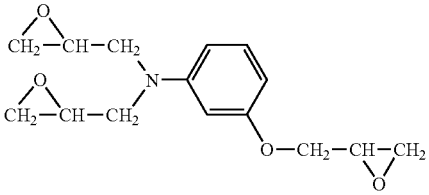

EP-27

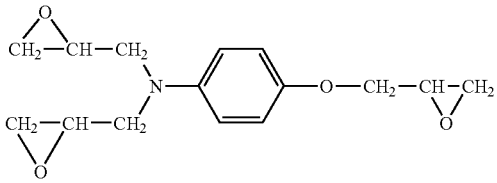

Most of the aforementioned compounds are marketed, and they can be easily obtained. As for addition method of the aforementioned compounds having an epoxy group, they may be dissolved in an organic solvent such as an alcohol, acetone and toluene or water and the solution may be added as it is, or they may be added after they are dispersed by using a surfactant such as dodecylbenzenesulfonate and nonylphenoxyalkylene oxide.

Besides the aforementioned compounds, carbodiimide compounds can also be used for the present invention, and preferred carbodiimide compounds are those represented by the following formulas.

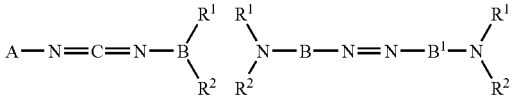

In the formulas, A represents an aliphatic group (e.g., methyl group, ethyl group, isopropyl group, n-butyl group, isobutyl group, tert-butyl group, allyl group, crotyl group, S-hydroxyethyl group, methoxymethyl-β-bromoallyl group), an aromatic group (e.g., phenyl group, tolyl group, xylyl group, naphthyl group, chlorophenyl group, bromophenyl group, iodophenyl group), an alicyclic group (e.g., cyclohexyl group, bronyl group, menthyl group) or a heterocyclic group (e.g., pyridyl group, quinolyl group). $R^1$ and $R^2$ represent a lower alkyl group (e.g., methyl group, ethyl group, propyl group, isopropyl group, butyl group), and B and $B^1$ (they may be identical to or different from each other) represent a group selected from an alkylene group, an arylene group, aralkylene group (e.g., propylene group, phenylene group, tolylene group, propylphenylene group) and so forth.

These di-substituted carbodiimides can be obtained by treating an N,N'-di-substituted symmetrical or unsymmetrical thiourea having at least one tertiary amino group with a desulfurizing agent such as oxide of a heavy metal such as lead or mercury as described in Berichte, vol. 71, pp. 1512-1521; ibid, vol. 73, pp. 467-477, pp. 1114-1123; ibid, vol. 75, pp. 100-105; Annalen, vol. 560, pp. 222-231; Journal of Organic Chemistry, vol. 102, pp. 4-6 and so forth. Typical examples of the compounds are mentioned below. However, the compounds that can be used for the present invention are not limited to these specific examples.

N-Isopropyl-N'-(4-dimethylaminophenyl)carbodiimide
N-Phenyl-N'-(4-dimethylaminophenyl)carbodiimide
N,N'-Di(4-dimethylaminophenyl)carbodiimide
N,N'-Di(4-dipropylaminotolyl)carbodiimide
N-Bornyl-N'-(4-dimethylaminophenyl)carbodiimide
N-Menthyl-N'-(4-dimethylaminophenyl)carbodiimide
N-(β-Bromoallyl)-N'-(γ-dimethylaminophenyl)carbodiimide
N-(tert-Butyl)-N'-(γ-dimethylaminophenyl)carbodiimide
N-Cyclohexyl-N'-(4-dimethylaminophenyl)carbodiimide
N-Isopropyl-N'-(γ-dimethylaminopropyl)carbodiimide
N-Methoxymethyl-N-(γ-dimethylaminopropyl)carbodiimide
N,N'-Di(γ-pyridyl)carbodiimide These N,N'-di-substituted carbodiimides having a tertiary amine moiety can also be converted into quaternary ammonium salts by allowing them to react with a suitable quaternizing agent such as methyl bromide, ethyl bromide, methyl iodide, ethyl iodide, dimethyl sulfate, diethyl sulfate, methyl p-toluenesulfonate and ethyl p-toluenesulfonate directly or in the presence of ethyl acetate, chloroform, benzene, toluene or a mixed solvent of these, and thereby their solubility can be controlled. They may also be added in the form of a quaternary salt.

Specific examples of the quaternized N,N'-di-substituted carbodiimides are mentioned below. However, the compounds that can be used for the present invention are not limited to these.

N-Isopropyl-N'-(4-dimethylaminophenyl)carbodiimide ethyl p-toluenesulfonate
N-Phenyl-N'-(4-dimethylaminophenyl)carbodiimide ethyl p-toluenesulfonate
N,N'-Di(4-dimethylaminophenyl)carbodiimide monoethobromide
N,N'-Di(4-dipropylaminotolyl)carbodiimide ethyl p-toluenesulfonate
N-Bornyl-N'-(4-dimethylaminophenyl)carbodiimide methosulfate
N-Menthyl-N'-(4-dimethylaminophenyl)carbodiimide ethosulfate
N-(β-Bromoallyl)-N'-(γ-dimethylaminophenyl)carbodiimide ethosulfate
N-(tert-Butyl)-N'-(γ-dimethylaminophenyl)carbodiimide ethyl p-toluenesulfonate
N-Cyclohexyl-N'-(4-dimethylaminophenyl)carbodiimide ethyl p-toluenesulfonate N-Isopropyl-N'-(γ-dimethylaminopropyl)carbodiimide ethobomide N-Methoxymethyl-N-(γ-dimethylaminopropyl)carbodiimide ethyl p-toluenesulfonate N,N'-Di(γ-pyridyl)carbodiimide monomethosulfate These hardening agents concerning the present invention such as the aziridine compounds, epoxy compounds and carbodiimide compounds are generally used in an amount of 0.002 mole or more per one mole of silver. Usually, the aforementioned compounds are used in an amount of 0.002-2 moles, preferably 0.003-0.3 mole, per one mole of silver.

The silver salt of an organic acid used for the photothermographic material of the present invention is a reducible silver source, and silver salts of an organic acid or heteroorganic acid containing a reducible silver ion source, particularly long-chain (10-30, preferably 15-25 carbon atoms) aliphatic carboxylic acids, are preferred. Organic or inorganic silver salt complexes having a total ligand stability constant of 4.0-10.0 with respect to silver ion are also useful. Preferred examples of silver salts are described in Research Disclosure (henceforth abbreviated as "RD") Nos. 17029 and 29963 and include the followings: salts of organic acids (e.g., salts of gallic acid, oxalic acid, behenic acid, arachidic acid, stearic acid, palmitic acid, lauric acid); silver salts of carboxyalkylthioureas (e.g., 1-(3-carboxypropyl)thiourea, 1-(3-carboxypropyl)-3,3-dimethylthiourea etc.); silver complexes of polymerization product of aldehydes (e.g., formaldehyde, acetaldehyde, butylaldehyde) with hydroxy-substituted aromatic carboxylic acid; hydroxy-substituted acids (e.g., salicylic acid, benzoic acid, 3,5-dihydroxybenzoic acid, 5,5-thiodisalicylic acid); silver salts or complexes of thioenes (e.g., 3-(2-carboxyethyl)-4-hydroxymethyl-4-thiazoline-2-thione, 3-carboxymethyl-4-thiazoline-2-thione); silver complexes or salts of nitrogenic acid selected from the group consisting of imidazole, pyrazole, urazole, 1,2,4-thiazole, 1H-tetrazole, 3-amino-5-benzylthio-1,2,4-triazole and benzotriazole; silver salts of saccharin, 5-chlorosalicylaldoxim etc.; and silver salts of mercaptides. Preferred silver sources are silver behenate, silver arachidate and/or silver stearate.

The silver salt of an organic acid can be obtained by mixing a water-soluble silver compound with a compound that form a complex with silver, and the forward mixing method, reverse mixing method, simultaneous mixing method and controlled double jet method as disclosed in JP-A-9-127643 and so forth are preferably used. For example, an aliphatic acid can be added with an alkali metal salt (e.g., sodium hydroxide, potassium hydroxide etc.) to produce an aliphatic acid alkali metal salt soap (e.g., sodium behenate, sodium arachidate etc.) and then the soap and silver nitrate or the like can be added by the controlled double jet method to prepare crystals of silver salt of an aliphatic acid. At that time, silver halide grains may be mixed.

In the present invention, the silver salt of an organic acid preferably has a mean particle size of 2 μm or less, and it is preferably monodispersed. The monodispersed state used herein is defined by the same equation as that for silver halide mentioned later. The monodispersed state of silver salt of an organic acid has the same meaning as that of silver halide, and when the silver salt of an organic acid shows a dispersion degree of 50% or less, it is morodispersed. More preferred are those grains showing a dispersion degree of 40% or less, particularly preferably 0.1-30%. When grains of the silver salt of an organic acid are, for example, spherical, rod-like or tabular grains, the mean particle size of silver salt of an organic acid means a mean diameter of spheres having the same volume of the silver salt of an organic acid. The mean particle size is preferably 0.05-1.5 μm, particularly preferably 0.05-1.0 μm. Moreover, the organic acid silver salt of the present invention preferably contains 60% or more of tabular grains with respect to the total silver salt of an organic acid. In the present invention, tabular grains mean those having a ratio of mean grain size and thickness, i.e., the so-called aspect ratio (abbreviated as "AR") represented by for following equation, of 3 or more.

AR=Mean particle size (μm)/thickness (μm)

In order to obtain such a shape of the silver salt of an organic acid, crystals of the organic acid silver salt can be dispersed and ground together with a binder, surfactant and so forth in a ball mill or the like. With such shape of the grains, a photosensitive material showing high density and superior image storability can be obtained.

In the present invention, the total amount of the silver halide and the silver salt of an organic acid is preferably 0.5-2.2 g in terms of silver per 1 $m^2$ in order to prevent devitrification of the photosensitive material. With an amount in such a range, an image of high contrast can be obtained. The amount of the silver halide with respect to the total silver amount is 50% by weight or less, preferably 25% by weight or less, further preferably 0.1-15% by weight.

Hereafter, high contrast agents that can be used for the present invention will be explained.

While types of high contrast agents used for the present invention are not particularly limited, examples of well-known high contrast agents include all of the hydrazine derivatives represented by the formula (H) mentioned in JP-A-2000-284399 (specifically, the hydrazine derivatives mentioned in Tables 1-4 of the same), and the hydrazine derivatives described in JP-A-10-10672, JP-A-10-161270, JP-A-10-62898, JP-A-9-304870, JP-A-9-304872, JP-A-9-304871, JP-A-10-31282, U.S. Pat. No. 5,496,695 and EP741,320A. There can be further mentioned the substituted alkene derivatives, substituted isoxazole derivatives and particular acetal compounds represented by the formulas (1) to (3) mentioned in JP-A-2000-284399, the cyclic compounds represented by the formula (A) or (B) mentioned in the same, specifically Compounds 1-72 mentioned in Chemical Formulas 8 to 12 of the same, and the compounds represented by the formulas (H), (G) and (P) mentioned in JP-A-2001-133924, specifically those of Chemical Formulas 3 to 9 and 11 to 53 of the same.

High contrast agents particularly preferably used in the present invention include the hydrazine derivatives represented by the formulas (H-1), (H-2), (H-3), (H-4), (H-5) and (H-1-1) mentioned in JP-A-2001-27790 (specifically, Compounds H-1-1 to H-1-28, Compounds H-2-1 to H-2-9, Compounds H-3-1 to H-3-12, Compounds H-4-1 to H-4-21 and Compounds H-5-1 to H-5-5 mentioned in the same), and the substituted alkene derivatives represented by the formula (1) mentioned in JP-A-2001-125224 (specifically, compounds mentioned in Chemical Formulas 10 to 55 of the same).

The high contrast agents used for the present invention may be used after being dissolved in water or an appropriate organic solvent such as alcohols (e.g., methanol, ethanol, propanol, fluorinated alcohol), ketones (e.g., acetone, methyl ethyl ketone), dimethylformamide, dimethyl sulfoxide or methyl cellosolve.

They may also be used as an emulsified dispersion mechanically prepared according to an already well known emulsification dispersion method by using an oil such as dibutyl phthalate, tricresyl phosphate, glyceryl triacetate or diethyl phthalate, and an auxiliary solvent such as ethyl acetate or cyclohexanone. Alternatively, the high contrast agents may be used after dispersion of a powder of the high contrast agents in a suitable solvent such as water by using a ball mill, a colloid mill or the like, or by means of ultrasonic wave according to a known method for solid dispersion.

The high contrast agents used in the present invention may be added to any layers on the image-forming layer side of the support. However, the compounds are preferably added to the image-forming layer or a layer adjacent thereto. As for the amount of the high contrast agent, optimum amount may differ depending on particle size, halogen composition, degree of chemical sensitization of silver halide grains, type of inhibitor and so forth, and it cannot be generally defined. However, it is preferably from $1\times10^{-6}$ to 1 mole, particularly preferably from $1\times10^{-5}$ to $5\times10^{-1}$ mole, per mole of silver.

The photothermographic material of the present invention may contain the compounds represented by the formula 1 mentioned in JP-A-2000-122220 (antifoggants) for the purpose of obtaining high sensitivity or prevention of fog. Specifically, the compounds of Chemical Formulas 3 to 12 described in the same can be mentioned.

As the aforementioned compounds used as antifoggants for the present invention, commercially available compounds can be used. Alternatively, they can also be synthesized by, for example, the methods described in Chem. Pharm. Bulletin, 31 (8), 2632 (1983); J. Chem. Soc., Section B; Physical Organic Chemistry, Part 1, pp. 145-148 (1971); J. Amer. Chem. Soc., 77, 1909 (1955); Org. Prep. Proced. Int., 28 (5), 609 (1996); Chem. Ber., 44, 1236 (1911); J. Amer. Chem. Soc., 60, 2502 (1938); Bull. Soc. Khim. Fr., 25 (3), 173 (1901); Chem. Abstr., 9861 (1960); DE297018; Justus Liebigs Ann. Chem., 300 299, (1898) and so forth.

Although the amount of the aforementioned compounds used for the present invention as antifoggants is not particularly limited, they are preferably used in an amount of $10^{-4}$ mole to 1 mole/Ag mole, particularly preferably $10^{-3}$ mole to 0.3 mole/Ag mole.

The compounds used for the present invention as antifoggants can be added to either a photosensitive layer or a non-photosensitive layer, but preferably added to the photosensitive layer. As a photothermographic material having at least one photosensitive layer and an adjacent layer on a support, typical embodiments include those in which (1) the photosensitive layer contains a photosensitive silver halide, an silver salt of an organic acid and a binder and further contains at least one aforementioned compounds used as antifoggants, (2) the photosensitive layer contains a photosensitive silver halide, a silver salt of an organic acid and a binder and an adjacent layer contains at least one aforementioned compounds used as antifoggants, (3) the photosensitive layer contains a photosensitive silver halide and a binder and further contains at least one aforementioned compounds used as antifoggants and an adjacent layer contains an silver salt of an organic acid, and (4) the photosensitive layer contains a photosensitive silver halide and a binder and an adjacent layer contains an silver salt of an organic acid and at least one aforementioned compounds used as antifoggants. Preferred for the present invention is the embodiment of (1).

The aforementioned compounds used as antifoggants are preferably added after being dissolved in an organic solvent.

The photosensitive silver halide used for the photothermographic material of the present invention can be prepared by any method known in the field of photographic techniques including the single jet method and double jet method, and they can also be prepared by, for example, any of the ammonia method, neutral method, acidic method and so forth. The photosensitive silver halide can be prepared beforehand as described above, then mixed with other components used for the present invention and introduced into the composition used for the present invention. In this case, in order to obtain sufficient contact of the photosensitive silver halide and the silver salt of an organic acid, there can be used, for example, means of using polymer other than gelatin such as polyvinyl acetals described in U.S. Pat. Nos. 3,706,564, 3,706,565, 3,713,833, 3,748,143 and British Patent No. 1,362,970 as a protective polymer during the preparation of the photosensitive silver halide, means of enzymatically decomposing gelatin of the photosensitive silver halide emulsion as described in British Patent No. 1,354,186, means of preparing the photosensitive silver halide grains in the presence of a surfactant to omit use of protective polymer as disclosed in U.S. Pat. No. 4,076,539 and so forth.

The silver halide contained in the emulsion functions as a photosensor. It is preferable to use silver halide grains having a small grain size in order to reduce cloudiness after the image formation and improve quality of formed images, and the mean grain size is preferably 0.1 μm or less, more preferably 0.01-0.1 μm, particularly preferably 0.02-0.08 μm. The grain size used herein means a ridge length of a silver halide grain for normal crystals including cubic crystals and octahedral crystals, or a diameter of a sphere having the same volume as a silver halide grain for crystals that are not normal crystals, e.g., spherical grains, rod-like grains and tabular grains. The silver halide is preferably monodispersed. The monodispersion used herein means that the monodispersion degree obtained according to the following equation is 40% or less. More preferred are grains showing a monodispersion degree of 30% or less, particularly preferably 0.1-20%.

$$\text{Monodispersion degree}=\{(\text{Standard deviation of grain size})/(\text{Average of grain size})\}\times100$$

In the present invention, the silver halide grains are more preferably monodispersed grains having a mean grain size of 0.1 μm or less. With grains falling within such a range, graininess of image is also improved.

The shape of the silver halide is not particularly limited, and there are the so-called normal crystals of cubic form, octahedral form or the like, and those that are not normal crystals such as spherical grains, rod-like grains and tabular grains. The halogen composition is not also particularly limited, and any of silver chloride, silver chlorobromide, silver chloroiodobromide, silver bromide, silver iodobromide and silver iodide may be used.

The amount of the silver halide is 50% or less, preferably 25-0.1%, further preferably 15-0.1%, with respect to the total amount of the silver halide and the aforementioned silver salt of an organic acid.

Further, the photosensitive silver halide used in the photothermographic material of the present invention can be produced almost simultaneously with the production of the organic acid silver salt by injecting silver ions into a mixture in which a halogen component such as halide ions and an organic acid silver salt-forming component coexist when the organic acid silver salt is formed, as described in British Patent No. 1,447,454.

Furthermore, it is also possible to allow a silver halide-forming component to act on a previously prepared organic acid silver salt solution or dispersion, or a sheet material containing a silver salt of an organic acid to convert a part of the organic acid silver salt into the photosensitive silver halide. The photosensitive silver halide prepared as described above effectively contacts with the organic acid silver salt to exhibit a desirable effect. The aforementioned photosensitive silver halide-forming component is a compound capable of forming a photosensitive silver halide by the reaction with a silver salt of an organic acid. What kinds of compounds correspond to such a compound and are effective as such a compound can be determined by the following simple test. That is, a compound to be tested is mixed with a silver salt of an organic acid and optionally heated. Thereafter, the mixture is examined by X-ray diffractiometry to determine whether a diffraction peak characteristic to the silver halide is present or not. Examples of photosensitive silver halide-forming components that are confirmed as being effective by such a test as described above include inorganic halogenides, onium halides, halogenated hydrocarbons, N-halogenated compounds and other halogen-containing compounds. Specific examples of such compounds are described in detail in U.S. Pat. Nos. 4,009,039, 3,457,075, 4,003,749, British Patent No. 1,498,956, JP-A-53-27027 and JP-A-53-25420.

The photosensitive silver halide-forming component is used in a stoichiometrically small amount compared with the amount of organic acid silver salt. The amount is generally in the range of 0.001-0.7 mole, preferably 0.03-0.5 mole, per mole of the silver salt of an organic acid. Two or more kinds of photosensitive silver halide-forming components may be used within the aforementioned range. Although conditions of the process for converting a part of the silver salt of an organic acid into the photosensitive silver halide using the photosensitive silver halide-forming component, such as reaction temperature, reaction time or reaction pressure etc., can be suitably selected from wide ranges according to the purpose of production, it is generally preferred that the reaction temperature should be 20-70° C., the reaction time be 0.1 seconds to 72 hours, and the reaction pressure be atmospheric pressure. Further, it is preferred that the reaction should be carried out in the presence of a polymer used as a binder described later. The amount of the polymer used in this case is in the range of 0.01-100 parts by weight, preferably 0.1-10 parts by weight, based on 1 part by weight of the silver salt of an organic acid.

The photosensitive silver halide prepared by the aforementioned various methods can be chemically sensitized with, for example, sulfur containing compounds, gold compounds, platinum compounds, palladium compounds, silver compounds, tin compounds, chromium compounds or a combination of these. The methods and procedures of chemical sensitization are described in, for example, U.S. Pat. No. 4,036,650, British Patent No. 1,518,850, JP-A-51-22430, JP-A-51-78319 and JP-A-51-81124. In case of converting a part of the silver salt of an organic acid into the photosensitive silver salt using the photosensitive silver halide-forming component, the sensitization can be carried out in the presence of an amide compound having a low molecular weight as described in U.S. Pat. No. 3,980,482.

Moreover, the photosensitive silver halide may contain ions of metals belonging to Groups VI to XI of the periodic table of elements, such as Rh, Ru, Re, Ir, Os and Fe, complexes thereof or complex ions thereof for illumination intensity failure or control of gradation. In particular, addition of the metals as complex ions is preferred, and for example, Ir complex ions such as $[IrCl_6]^{2-}$ may be added for illumination intensity failure.

As for the chemical sensitization method for the photosensitive silver halide grains used in the present invention, they are preferably chemically sensitized with a chalcogen as well known in the field. That is, sulfur sensitization, selenium sensitization, tellurium sensitization, noble metal sensitization using a gold compound, platinum compound, palladium compound, iridium compound or the like and reduction sensitization can be used.

It is preferred that the photothermographic material should be chemically sensitized with a chalcogen compound. Chemical sensitization with a chalcogen compound or gold compound is disclosed in JP-A-9-297370 or JP-A-11-65020. However, these references mention high sensitivity and high Dmax as the effects of the chemical sensitization, and they do not refer to running stability or stabilization of half tone dot % fluctuation. Therefore, the correlation with the object and advantage of the present invention is not recognized in the references. In the present invention, the silver halide grains are preferably subjected to chemical sensitization with a chalcogen compound before they are mixed with the silver salt of an organic acid.

As sulfur sensitizers that can be used for the present invention, there can be mentioned, besides sulfur compounds contained in gelatin, various sulfur compounds, for example, thiosulfates, thioureas, thiazoles, rhodanines and so forth. Specific examples thereof include those mentioned in U.S. Pat. Nos. 1,574,944, 2,278,947, 2,410,689, 2,728,668, 3,501,313 and 3,656,955.

Any selenium compounds conventionally known and mentioned in patent documents can be employed as the selenium sensitizers that can be used in the present invention. That is, a labile selenium compound and/or a non-labile selenium compound is generally used by adding it to an emulsion and stirring it at a high temperature, preferably at 40° C. or higher, for a certain period of time. As the labile selenium compounds, the compounds described in JP-3-41-15748, JP-B-43-13489, JA-A-4-25832, JP-A-4-109240 and so forth are preferably used. Examples of the labile selenium compounds include isoselenocyanates (e.g., aliphatic isoselenocyanates such as allyl isoselenocyanate), selenoureas, selenoketones, selenoamides, selenocarboxylic acids (e.g., 2-selenopropionic acid, 2-selenobutyric acid), selenoesters, diacylselenides (e.g., bis(3-chloro-2,6-di-methoxybenzoyl) selenide), selenophosphates, phosphine selenides, colloidal metallic selenium and so forth.

As the non-labile selenium compounds used in the present invention, the compounds described in JP-B-46-4553, JP-B-52-34492 and JP-B-52-34491 are used. Examples of the non-labile selenium compounds include selenious acid, potassium selenocyanide, selenazoles, quaternary salts of selenazoles, diaryl selenides, diaryl diselenides, dialkyl selenides, dialkyl diselenides, 2-selenazolidinedione, 2-selenooxazolidinethione, derivatives thereof and so forth.

Examples of the tellurium sensitizer used for the present invention include the compounds described in JP-A-4-204640, JP-A-4-271341, JP-A-4-333043, JP-A-5-303157, JP-A-6-027573, JP-A-6-175258, JP-A-6-180478, JP-A-6-208186, JP-A-6-208184, JP-A-6-317867, JP-A-7-092599, JP-A-7-098483, JP-A-7-104415, JP-A-7-140579, J. Chem. Soc. Chem. Commun., 635 (1980); S. Patai (compiler), The Chemistry of Organic Selenium and Tellurium Compounds, Vol. 1 (1986); ibid., vol. 2 (1987) and so forth.

In the present invention, chemical sensitization by at least one of selenium sensitization and tellurium sensitization is preferred. Tellurium sensitization is particularly preferred. Moreover, in the present invention, although sulfur sensitization, selenium sensitization and tellurium sensitization may be used each alone and they may be used in any combination, a combination of two or three kinds of them is used as a preferred embodiment.

Although the amount of the chalcogen sensitizer used in the present invention is not particularly limited so long as the effect of the present invention should be exerted, it is preferably $1\times10^{-8}$ to $1\times10^{-1}$ mole, more preferably $1\times10^{-7}$ to $1\times10^{-2}$ mole, per one mole of silver halide.

The support used in the present invention is preferably a plastic film (e.g., polyethylene terephthalate (PET), polycarbonate, polyimide, nylon, cellulose triacetate, polyethylene naphthalate) in order to prevent thermal deformation of images after development. The support has a thickness of preferably 110-140 μm, more preferably 110-130 μm, further preferably 110-125 μm. If the thickness is less than 110 μm, thermal deformation during heat development tends to become significant, and unevenness of the surface tends to be caused after the heat development. Further, if the thickness is larger than 140 μm, cutting chips are generated when a rolled film is cut in a plotter or the film is cut after the development, and they tends to become a factor of causing printing blur or image defects in the platemaking step.

In the present invention, a plastic support subjected to a heat treatment can also be used. The aforementioned plastics can be mentioned as plastics to be used. For the heat treatment of the support, the support is preferably heated to a temperature higher than the glass transition point of the support by 30° C. or more, preferably 35° C. or more, further preferably 40° C. or more, after formation of the film and before coating of the image-forming layer. However, if the support is heated at a temperature exceeding the melting point of the support, the advantage of the present invention can no longer be obtained.

While known methods can be used as the methods for forming film of the support and preparing undercoat layers of the support used for the present invention, the methods described in JP-A-9-50094, paragraphs 0030 to 0070 are preferably used.

The photosensitive material of the present invention has an image-forming layer on one side of the support, and the uppermost layer on the image-forming layer side preferably has a Vickers hardness of 40-150.

The Vickers hardness referred to in the present invention is defined as hardness that can be measured according to the microhardness measurement method of JIS Z 2251. Specifically, it means a quotient obtained by dividing a load F (kgf) used for forming an indent on a test surface with a diamond indenter of a regular quardrangular pyramid shape having a tip sharp angle of 136° with a surface area of the indent obtained from an average length of diagonal lines of the indent d (mm), and calculated in accordance with the following equation.

$$\text{Vickers hardness}(Hv)=1.8544\ F/d^2$$

The measurement apparatus must be one conforming to JIS B 7734 (microhardness tester). For example, the measurement is preferably conducted by using MHA-400 (NEC Corp.) at 23° C. and relative humidity of 50%. The hardness is determined when the indenter is pushed into the photosensitive material having a support as a sample for a depth of 50% of the thickness from the uppermost surface as observed by scanning electron microscopy (SEM).

In order to obtain a Vickers hardness within the aforementioned range, a method of adding the hydrophobic binder described below to the uppermost layer, a method of controlling the hardness with a matting agent, a method of adding solid filler to control the hardness and so forth can be used.

As the hydrophobic binder, polyvinyl butyral, cellulose acetate, cellulose acetate butyrate, polyester and polymer latex are particularly preferably used.

The photothermographic material of the present invention has at least one image-forming layer on the support. Although only the image-forming layer may be formed on the support, at least one non-image-forming layer is preferably formed on the image-forming layer. In order to control amount or wavelength distribution of light transmitting the image-forming layer, a filter dye layer may be provided on the same side as the image-forming layer and/or an antihalation dye layer, a so-called backing layer, may be provided on the opposite side, and a dye or pigment may be added to the image-forming layer. Although any compounds showing desired absorption at a desired wavelength may be used, preferably used are, for example, the dyes described in JP-A-59-6481, JP-A-59-182436, U.S. Pat. Nos. 4,271,263, 4,594,312, European Patent Publication Nos. 533,008, 652,473, JP-A-2-216140, JP-A-4-348339, JP-A-7-191432, JP-A-7-301890 and so forth.

The dyes particularly preferably used in the present invention include the compounds represented by the formulas (1a), (2), (3), (1b) and (1c) mentioned in JP-A-2001-5135, specifically those of Chemical Formulas 86 to 89 mentioned in the same.

In the present invention, the non-image-forming layer provided on the image-forming layer preferably contains a matting agent, and the matting agent is preferably contained in an amount of 1.0-50% by weight of the total amount of the binder on the photosensitive layer side.

The material of the matting agent preferably consists of an inorganic substance, and there can be used, for example, silica described in Swiss Patent No. 330,158 etc., glass powder described in French Patent No. 1,296,995 etc., carbonates of alkaline earth metals, cadmium, zinc etc. described in British Patent No. 1,173,181 etc. and so forth. The matting agent used for the present invention further include irregular shaped silica, boron nitride, aluminum nitride, spherical silica, titanium dioxide, magnesium oxide, aluminum oxide, calcium carbonate, hydroxyapatite, magnesium carbonate, barium sulfate, strontium sulfate and so forth.

While the matting agent may have a regular form or irregular form, it preferably has a regular form, and a spherical form is preferably used. The size of the matting agent is represented by a diameter of sphere having the same volume as the matting agent. In the present invention, particle size of the matting agent means a diameter of sphere having the same volume as the matting agent. The matting agent used for the present invention preferably has a mean particle size of 0.5-10 μm, more preferably 1.0-8.0 μm. Moreover, it preferably has a variation coefficient of 50% or less, more preferably 40% or less, particularly preferably 30% or less, for particle size distribution.

The variation coefficient for particle size distribution means a value calculated in accordance with the following equation.

$$\text{Variation coefficient}=\{(\text{Standard deviation of particle size})/(\text{Average of particle size})\}\times 100$$

Although the matting agent used for the present invention may be contained in an arbitrary non-photosensitive layer, it is preferably contained in the most outside layer with respect to the support (outermost surface layer).

The matting agent used for the present invention may be added by a method of preliminarily dispersing it in a coating solution and applying it, or there may be used a method of applying a coating solution and then spraying the matting agent before drying is completed. Moreover, when two or more kinds of matting agents are added, the both methods may be used in combination.

In the present invention, the non-image-forming layer may contain, besides the matting agent, a lubricant such as polysiloxane compounds, wax and liquid paraffin. The image-forming layer may consist of multiple layers, and the image-forming layer may consist of a combination of high sensitivity layer/low sensitivity layer or low sensitivity layer/high sensitivity layer for control of gradation.

The photothermographic material of the present invention is used for forming a photographic image by heat development and preferably a photothermographic material containing at least a reducible silver source (silver salt of an organic acid), a photosensitive silver halide, a developing agent (reducing agent) and optionally a toning agent for suppressing color tone of silver as required, which are usually dispersed in an (organic) binder matrix. The photothermographic material of the present invention is stable at an ambient temperature, but it is developed upon heating to a high temperature (e.g., 80-140° C.) after light exposure. By heating, silver is produced through an oxidation-reduction reaction between the silver salt of an organic acid (which functions as an oxidizing agent) and the reducing agent. This oxidation-reduction reaction is accelerated by catalytic action of a latent image generated upon exposure. The silver produced by the reaction of the silver salt of an organic acid in the exposure area provides a black image and this presents a contrast to the non-exposure area to form an image. This reaction process proceeds without supply of processing solutions such as water from the outside.

The photothermographic material contains a reducing agent. Preferred examples of the reducing agent are disclosed in U.S. Pat. Nos. 3,770,448, 3,773,512, 3,593,863, RD Nos. 17029 and 29963, and include aminohydroxycycloalkenone compounds (e.g., 2-hydroxypiperidino-2-cyclohexenone); esters of aminoreductones (e.g., piperidinohexose reductone monoacetate) acting as precursors of reducing agent; N-hydroxyurea derivatives (e.g., N-p-methylphenyl-N-hydroxyurea); hydrazones of aldehyde or ketone (e.g., anthracenaldehydephenyl hydrazone), phosphor-amide phenols; phosphor-amide anilines; polyhydroxybenzenes (e.g., hydroquinone, tert-butyl-hydroquinone, isopropylhydroquinone, (2,5-dihydroxy-phenyl)methylsulfone); sulfhydroxamic acids (e.g., benzenesulfhydroxamic acid); sulfonamidanilines (e.g., 4-(N-methanesulfonamido)aniline); 2-tetrazolylthiohydroquinones (e.g., 2-methyl-5-(1-phenyl-5-tetrazolylthio)hydroquinone); tetrahydroquinoxalines (e.g., 1,2,3,4-tetrahydroquinoxaline); amidoxims; combination of azines (e.g., aliphatic carboxylic acid aryl hydrazides) and ascorbic acid; combination of polyhydroxybenzene and hydroxylamine, reductone and/or hydrazine; hydroxamic acids; combinations of azine and sulfonamidephenol; α-cyanophenylacetic acid derivatives; combinations of bis-β-naphthol and 1,3-dihydroxybenzene derivative; 5-pyrazolones; sulfonamidophenol reducing agents; 2-phenylinedan-1,3-diones; chromans; 1,4-dihydroxypyridines (e.g., 2,6-dimethoxy-3,5-dicarboethoxy-1,4-dihydropyridine); bispheriols (e.g., bis(2-hydroxy-3-tert-butyl-5-methylphenyl)methane, bis(6-hydroxy-m-tri)-mesitol, 2,2-bis(4-hydroxy-3-cethylphenyl) propane, 4,5-ethylidene-bis(2-tert-butyl-6-methyl)phenol); ultraviolet-sensitive ascorbic acid derivatives; 3-pyrazolidones and so forth. Particularly preferred as the reducing agent are hindered phenols. Examples of the hindered phenols include the compounds represented by the formula (A) mentioned in JP-A-2001-133924, specifically those of Chemical Formulas 65 and 66 mentioned in the same.

The amount of the reducing agent used in the present invention is preferably $1\times10^{-2}$ to 10 moles, particularly preferably $1\times10^{-2}$ to 1.5 moles, per one mole of silver.

The photothermographic material of the present invention desirably contains an additive called toning agent, color tone imparting agent or activation toner (henceforth referred to as "toning agent") together with the components described above. The toning agent has a function of being involved in the oxidation/reduction reaction of the silver salt of an organic acid and the reducing agent to impart a darker color, especially black color, to the produced silver image. Preferred examples of the toning agent are disclosed in RD No. 17029 and include imides (e.g., phthalimide); cyclic imides, pyrazolin-5-ones and quinazolinone (e.g., succinimide, 3-phenyl-2-pyrazolin-5-one, 1-phenylurazole, quinazoline, 2,4-thiazolidinedione); naphthalimides (e.g., N-hydroxy-1,8-naphthalimide); cobalt complexes (e.g., cobalt hexaminetrifluoroacetate), mercaptanes (e.g., 3-mercapto-1,2,4-triazole); N-(aminomethyl)aryldicarboxylmides (e.g., N-(dimethylaminomethyl)phthalimide); blocked pyrazoles, isothiuronium derivatives, and combination of certain kinds of light bleaching agents (e.g., combination of N,N'-hexamethylene(1-carbamoyl-3,5-dimethylpyrazole), 1,8-(3,6-dioxaoctane)bis(isothiuroniumtrifluoroacetate) and 2-(tribromomethylsulfonyl)benzothiazole); melocyanine dyes (e.g., 3-ethyl-5-((3-ethyl-2-benzothiazolinylidene(benzothiazolinylidene))-1-methylethylidene)-2-thio-2,4-oxaz olidinedione); phthalazinone, phthalazinone derivatives and metallic salts thereof (e.g., 4-(1-naphtyl)phthalazinone, 6-chlorophthalazinone, 5,7-dimethyloxyphthalazinone, 2,3-dihydro-1,4-phthalazinone); combination of phthalazinone and sulfinic acid derivative (e.g., 6-chlorophthazinone+sodium benzenesulfinate, 8-methylphthalazinone+sodium p-toluenesulfonate); combination of phthalazine and phthalic acid; combination of phthalazine (including adduct of phthalazine) and at least one compound selected from the group consisting of maleic anhydride, phthalic acid, 2,3-naphthalenedicarboxylic acid, o-phenylenic acid derivative and anhydrides thereof (e.g., phthalic anhydride, 4-methylphthalic anhydride, 4-nitrophthalic anhydride, tetrachlorophthalic anhydride); quinazolinediones, benzoxazines, ortho-oxazine derivatives; benzoxazine-2,4-diones (e.g., 1,3-benzoxazine-2,4-dione); pyrimidines and asymmetric triazines (e.g., 2,4-dihydroxypyrimidine), and tetrazapentalene derivatives (e.g., 3,6-dimercapto-1,4-diphenyl-1H,4H-2,3a,5,6a-tetrazapentalene). Among these, preferred toning agents are phthalazones and phthalazines.

The photothermographic material of the present invention may contain a sensitizing dye disclosed in, for example, JP-A-63-159841, JP-A-60-140335, JP-A-63-231437, JP-A-63-259651, JP-A-63-304242, JP-A-63-15245, U.S. Pat. Nos. 4,639,414, 4,740,455, 4,741,966, 4,751,175 and 4,835,096. Useful sensitizing dyes that can be used for the present invention are described in RD No. 17643, item IV-A (page 23, December 1978) and ibid. No. 1831, item X (page 437, August 1979) and the references cited therein. In particular, sensitizing dyes having spectral sensitivity suitable for spectral characteristics of light sources of various scanners can be advantageously selected. For example, the compounds described in JP-A-9-34078, JP-A-9-54409 and JP-A-9-80679 are preferably used.

Particularly preferably used sensitizing dyes include the compounds represented by the formulas [1] to [4] mentioned in JP-A-2001-100360, specifically those of Chemical Formulas 5 to 16 mentioned in the same.

The aforementioned infrared sensitive dyes or spectral sensitizing dyes can be readily synthesized by, for example, the methods described in F. M. Hamer, The Chemistry of Heterocylic Compounds, The Cyanine Dyes and Related Compounds, A. Weissberger ed., Interscience Co., New York (1964), JP-A-3-138638, JP-A-10-73900, International Patent Publication in Japanese (Kohyo) No. 9-510022, U.S. Pat. No. 2,734,900, British Patent No. 774,779 and so forth. Further, the production methods are specifically described in JP-A-2000-95958 and so forth.

The sensitizing dyes may be used individually or in combination of two or more kinds of them in the present invention. The sensitizing dyes used in the present invention are added, either when they are used individually or in combination of two or more kinds of them, in an amount of preferably $5\times10^{-7}$ to $1.5\times10^{-6}$ mole, further preferably $8\times10^{-7}$ to $1.4\times10^{-6}$ mole, in total per 1 $m^2$ of the photothermographic material.

When supersensitization is performed, photosensitivity becomes particularly high. Therefore, when the reducing agent is not inactivated, print out silver is likely to be increased after the development, and thus it is particularly effective for the present invention. Moreover, when infrared sensitization is performed, the infrared sensitizing dye further has an oxidation/reduction potential that enables reduction of the silver halide and the silver salt of an organic acid to a certain extent. Therefore, silver clusters that become fogged silver are likely to be produced in the presence of the reducing agent that can reduce the aforementioned silver salt of an organic acid even in a dark place. The produced silver clusters serve as catalyst nuclei and may induce fog. Therefore, there are caused phenomena that storability is degraded during storage in a dark place, print out silver increases when the materials are left in a light place after the development and so forth. Furthermore, since sensitivity of infrared photosensitive materials is extended to the heat radiation region that is out of the region of visible light, they are effective for phenomena that print out silver increases due to heat radiation rays even in a dark place and so forth. In particular, the effect becomes significant in photothermographic materials subjected to infrared spectral sensitization, of which sensitivity is increased with a supersensitizer.

Although these sensitizing dyes may be used individually, a combination thereof may also be used. A combination of sensitizing dyes is often used for the purpose of, in particular, supersensitization. In combination with a sensitizing dye, a dye which itself has no spectral sensitization effect, or a material that absorbs substantially no visible light, but exhibits supersensitization may be incorporated into the emulsion. Useful sensitizing dyes, combinations of dyes that exhibit supersensitization, and materials that show supersensitization are described in, for example, RD No. 17643, page 23, Item IV-J (December 1978), JP-B-49-25500, JP-B-43-4933, JP-A-59-19032, JP-A-59-192242, JP-A-5-341432 and so forth.

The supersensitizer is preferably to used in an emulsion layer containing the silver salt of an organic acid and silver halide grains in an amount of 0.001-1.0 mole per one mole of silver. It is particularly preferably used in an amount in the range of 0.01-0.5 mole per one mole of silver.

The photothermographic material of the present invention may contain an antifoggant. As effective antifoggants, mercury compounds known as described in U.S. Pat. No. 3,589,903 and so forth are not preferred for the environmental reason. Therefore, non-mercury antifoggants have been researched for a long period of time. As non-mercury antifoggants, the antifoggants disclosed in U.S. Pat. Nos. 4,546,075, 4,452,885 and JP-A-59-57234 are preferred.

In the present invention, an oxidizing agent that reduces fog after the development can be used. As such an oxidizing agent, there can be preferably used, for example, the compounds disclosed in JP-A-50-119624, JP-A-50-120328, JP-A-51-121332, JP-A-54-58022, JP-A-56-70543, JP-A-56-99335, JP-A-59-90842, JP-A-61-129642, JP-A-62-129845, JP-A-6-208191, TP-A-7-5621, JP-A-7-2781, JP-A-8-15809, U.S. Pat. Nos. 5,340,712, 5,369,000, 5,464,737, 3,874,946, 4,756,999, 5,340,712, EP605,981A1, EP622,666A1, EP631,176A1, JP-B-54-165, JP-A-7-2781, U.S. Pat. Nos. 4,180,665, 4,442,202 and so forth.

In the present invention, the oxidizing agent is preferably contained in an amount of 10 $mg/m^2$ to 3 $g/m^2$, more preferably 50 $mg/m^2$ to 1 $g/m^2$.

In the present invention, the oxidizing agent may be added in any form of a solution, powder, solid microparticle dispersion or the like, and it is particularly preferably dispersed as solid microparticles in the image-forming layer. Further, it may be added as a solution mixed with other additives such as sensitizing dye, reducing agent and toning agent.

As preferred antifoggants, there are preferably used, besides the aforementioned oxidizing agents, the compounds described in U.S. Pat. Nos. 3,874,946, 4,756,999, the compounds disclosed in JP-A-9-288328, paragraphs 0030 to 0036, the compounds disclosed in JP-A-9-90550, paragraphs 0062 to 0063, the compounds disclosed in U.S. Pat. No. 5,028,523, European Patent Nos. 600,587, 631,176, 605,981 and so forth.

A binder suitable for the photothermographic material of the present invention is transparent or translucent and generally colorless, and examples thereof include natural polymers, synthetic resins, homopolymers and copolymers and other film-forming media. Specific examples thereof include, for example, gelatin, gum arabic, poly(vinyl alcohol), hydroxyethylcellulose, cellulose acetate, cellulose acetate butyrate, poly(vinylpyrrolidone), casein, starch, poly(acrylic acid), poly(methyl methacrylate), poly(vinyl chloride), poly(methacrylic acid), copoly(styrene-maleic anhydride), copoly(styrene-acrylonitrile), copoly(styrene-butadiene), poly(vinyl acetal) (e.g., poly(vinyl formal), poly(vinyl butyral)), poly(ester), poly(urethane), phenoxy resin, poly(vinylidene chloride), poly(epoxide), poly(carbonate), poly(vinyl acetate), cellulose ester, poly(amide) and so forth. Although the binder may be hydrophilic or hydrophobic, it is preferable to use a hydrophobic transparent binder in order to reduce fog after heat development. Preferred binders are polyvinyl butyral, cellulose acetate, cellulose acetate butyrate, polyester, polycarbonate, polyacrylic acid, polyurethane and so forth. Among these, polyvinyl butyral, cellulose acetate, cellulose acetate butyrate and polyester are particularly preferably used.

As another class of preferred binders, polymer latex to be explained below can be mentioned. The polymer latex is preferably contained in the image-forming layer. The polymer latex is preferably contained in an amount of 50 weight or more with respect to the total binder. The term "polymer latex" used in the present invention means a dispersion comprising hydrophobic water-insoluble polymer dispersed in a water-soluble dispersion medium as fine particles. The dispersed state may be one in which polymer is emulsified in a dispersion medium, one in which polymer underwent emulsion polymerization, micelle dispersion, one in which polymer molecules have a hydrophilic partial structure and polymer chains themselves are dispersed in molecular state or the like.

The polymer latex used in the present invention is described in "Gosei Jushi Emulsion (Synthetic Resin Emulsion)", compiled by Taira Okuda and Hiroshi Inagaki, issued by Kobunshi Kanko Kai (1978); "Gosei Latex no Oyo (Application of Synthetic Latex)", compiled by Takaaki Sugimura, Yasuo Kataoka, Souichi Suzuki and Keishi Kasahara, issued by Kobunshi Kanko Kai (1993); Soichi Muroi, "Gosei Latex no Kagaku (Chemistry of Synthetic Latex)", Kobunshi Kanko Kai (1970) and so forth.

The dispersed particles preferably have an average particle size of about 1-50,000 nm, more preferably about 5-1,000 nm. The particle size distribution of the dispersed particles is not particularly limited, and the particles may have either wide particle size distribution or monodispersed particle size distribution. The polymer latex used in the present invention may be latex of the so-called core/shell type other than ordinary polymer latex having a uniform structure. In this case, use of different glass transition temperatures of core and shell may be preferred. The polymer latex used in the present invention preferably shows a minimum film forming temperature (MFT) of about −30 to 90° C., more preferably about 0-70° C. A film-forming aid may be added in order to control the minimum film forming temperature. The film-forming aid is also referred to as a plasticizer, and consists of an organic compound (usually an organic solvent) that lowers the minimum film forming temperature of the polymer latex. It is explained in, for example, the aforementioned Soichi Muroi, "Gosei Latex no Kagaku (Chemistry of Synthetic Latex)", Kobunshi Kanko Kai (1970).

Examples of polymer species used for the polymer latex include acrylic resin, polyvinyl acetate resin, polyester resin, polyurethane resin, rubber resin, polyvinyl chloride resin, polyvinylidene chloride resin and polyolefin resin, copolymers of monomers constituting these resins and so forth. The polymers may be linear, branched or crosslinked. They may be so-called homopolymers in which a single kind of monomers are polymerized, or copolymers in which two or more different kinds of monomers are polymerized. The copolymers may be random copolymers or block copolymers. The polymers may have a number average molecular weight of about 5,000-1,000,000, preferably from about 10,000-100,000. Polymers having a too small molecular weight may unfavorably suffer from insufficient mechanical strength of the image-forming layer, and those having a too large molecular weight may unfavorably suffer from bad film forming property.

Specific examples of the polymer latex used as the binder of the image-forming layer of the photothermographic material of the present invention include latex of methyl methacrylate/ethyl acrylate/methacrylic acid copolymer, latex of methyl methacrylate/2-ethylhexyl acrylate/styrene/acrylic acid copolymer, latex of styrene/butadiene/acrylic acid copolymer, latex of styrene/butadiene/divinylbenzene/methacrylic acid copolymer, latex of methyl methacrylate/vinyl chloride/acrylic acid copolymer, latex of vinylidene chloride/ethyl acrylate/acrylonitrile/methacrylic acid copolymer and so forth.

Such polymers are also commercially available and examples thereof include acrylic resins such as CEBIAN A-4635, 46583, 4601 (all produced by Dicel Kagaku Kogyo Co., Ltd), Nipol LX811, 814, 821, 820 and 857 (all produced by Nippon Zeon Co., Ltd.); polyester resins such as FINETEX ES650, 611, 675, 850 (all produced by Dai-Nippon Ink & Chemicals, Inc.), WD-size and WMS (both produced by Eastman Chemical); polyurethane resins such as HYDRAN AP10, 20, 30 and 40 (all produced by Dai-Nippon Ink & Chemicals, Inc.); rubber resins such as LACSTAR 7310K, 3307B, 4700H, 7132C (all produced by Dai-Nippon Ink & Chemicals, Inc.), Nipol LX416, 410, 438C and 2507 (all produced byNippon Zeon Co., Ltd.); polyvinyl chloride resins such as G351 and G576 (both produced by Nippon Zeon Co., Ltd.); polyvinylidene chloride resins such as L502 and L513 (both produced by Asahi Chemical Industry Co., Ltd.); and olefin resins such as CHEMIPEARL S120 and SA100 (both produced by Mitsui Petrochemical Industries, Ltd.) and so forth. These polymers may be used individually or, if desired, as a blend of two or more of them.

The polymer species of the polymer latex preferably contains about 0.1-10 weight % of carboxylic acid component such as acrylate or methacrylate component. When polymer latex is used for the image-forming layer, the image-forming layer preferably contains 50 weight % or more, more preferably 70 weight % or more, of the polymer latex based on the total binder. In this case, if desired, the image-forming layer may contain a hydrophilic polymer in an amount of 50 weight % or less of the total binder, such as gelatin, polyvinyl alcohol, methylcellulose, hydroxypropylcellulose, carboxymethyl-cellulose and hydroxypropylmethylcellulose. The amount of the hydrophilic polymer is preferably 30 weight % or less of the total binder in the image-forming layer.

The total amount of the binder in the image-forming layer is preferably 0.2-30 g/m$^2$, more preferably 1-15 g/m$^2$.

Moreover, in order to protect the surface of the photothermographic material or to prevent generation of scratches, a non-image-forming layer may be provided on the outside of the image-forming layer. The binder used forth is non-image-forming layer may be the same as or different from the binder used for the image-forming layer.

In the present invention, in order to increase the heat development speed, the amount of the binder in the image-forming layer is preferably 0.5-30 g/m$^2$, more preferably 1-15 g/m$^2$. If the amount is less than 0.5 g/m$^2$, density of unexposed areas increases markedly, and it may not be used.

The photothermographic material of the present invention is usually exposed with a light having a wavelength of 750-800 nm. As a plotter used for the light exposure, a plotter utilizing a laser diode (LD) that enables light exposure with an exposure time of $10^{-7}$ second or shorter as a light source is used. Any light source may be used so long as it can emit a light of electromagnetic wave spectrum of desired wavelength range. For example, dye lasers, gas lasers, solid state lasers, semiconductor lasers and so forth can be used. Semiconductor lasers are particularly preferably used in view of space saving and cost saving.

In the image formation method of the present invention, the aforementioned photothermographic material is preferably exposed with overlapped light beams of light sources. The term "overlapped" means that a vertical scanning pitch width is smaller than the diameter of the beams. For example, the overlap can be quantitatively expressed as FWHM/vertical-scanning pitch width (overlap coefficient), where the beam diameter is represented as a half width of beam strength (FWHM) In the present invention, it is preferred that this overlap coefficient should be 0.2 or more.

The scanning method of the light source of the plotter used in the present invention is not particularly limited, and the cylinder external surface scanning method, cylinder internal surface scanning method, flat surface scanning method and so forth can be used. Although the channel of light source may be either single channel or multichannel, a multichannel comprising two or more of laser heads is preferred, because it provides high output and shortens writing time. In particular, for the cylinder external surface scanning method, a multichannel carrying several to several tens or more of laser heads is preferably used.

If a photothermographic material to be exposed shows low haze upon light exposure, it is likely to generate interference fringes and therefore it is preferably to prevent it. As techniques for preventing such interference fringes, there are known a technique of obliquely irradiating a photosensitive material with a laser light as disclosed in JP-A-5-113548, a technique of utilizing a multimode laser as disclosed in WO95/31754 and so forth, and these techniques are preferably used.

The scanning method of the light source of the plotter preferably used for the present invention is the inner drum method (cylinder internal surface scanning method). The light exposure is attained by scanning the surface of the photothermographic material transported into the inner drum section with a laser light emitted from a laser diode and reflected by a polygon mirror (prism). The exposure time for the main scanning direction is determined by the rotation number of the polygon mirror and the inner diameter of the drum. The main scanning speed on the surface of the photothermographic material of the present invention is preferably 500-1500 m/second, more preferably 1100-1500 m/second.

If a photothermographic material to be exposed shows low haze upon light exposure, it is likely to generate interference fringes and therefore it is preferable to prevent it. As techniques for preventing such interference fringes, there are known a technique of obliquely irradiating a photosensitive material with a laser light as disclosed in JP-A-5-113548, a technique of utilizing a multimode laser as disclosed in WO95/31754 and so forth, and these techniques are preferably used.

In the image formation method of the present invention, the photothermographic material is light-exposed to form a latent image, and then subjected to development in a development apparatus equipped with a preheating section, a heat development section and a gradual cooling section. The development temperature in the development apparatus is preferably 80-250° C., more preferably 100-140° C. The development time in the development apparatus is preferably 1-180 seconds, more preferably 5-90 seconds, in total. Further, the heat development speed in the heat development section in the heat development apparatus is preferably 21-100 mm/second, more preferably 27-50 mm/second.

The light-exposed photothermographic material is first heated in the preheating section. The preheating section is provided in order to prevent uneven development caused by dimensional change of the photothermographic material during the heat development. As for the heating in the preheating section, temperature is desirably controlled to be lower than the heat development temperature (for example, lower by about 10-30° C.), and the temperature and time in this section are desirably adjusted so that they can be sufficient for evaporating moisture remaining in the photothermographic material. The temperature is also preferably adjusted to be higher than the glass transition temperature (Tg) of the support of the photothermographic material so that uneven development can be prevented. It is generally preferred that the photothermographic material should be heated at a temperature of 80° C. or higher but lower than 115° C. for 5 seconds or more.

The photothermographic material heated at the preheating section is subsequently heated in the heat development section. In the image formation method of the present invention, the heat development section is provided with heating members on image-forming layer side and back layer side and transportation rollers only on the image-forming layer side with respect to the photothermographic material to be transported. For example, when the photothermographic material is transported so that it can have the image-forming layer on the upper side, there is employed a configuration that no transportation rollers are provided on the lower side of the photothermographic material (back layer side of the photothermographic material) and transportation rollers are provided only on the upper side (image-forming layer side of the photothermographic material) with respect to the transportation plane of the photothermographic material. In the present invention, generation of uneven density and physical deformation are prevented by employing the above configuration of the heat development section.

In the heat development section, the photothermographic material is heated by heating members such as heaters. The heating temperature in the heat development section is a temperature sufficient for the heat development, and it is generally 110-140° C. Since the photothermographic material is subjected to a high temperature of 110° C. or higher in the heat development section, a part of the components contained in the material or a part of decomposition products produced by the heat development may be volatilized. It is known that these volatilized components invite various bad influences, for example, they may cause uneven development, erode structural members of development apparatuses, deposit at low temperature portions as dusts to cause deformation of image surface, adhere to image surface as stains and so forth. As a method for eliminating these influences, it is known to provide a filter on the heat development apparatus, or suitably control air flows in the heat development apparatus. These methods may be effectively used in combination. For example, WO95/30933, WO97/21150 and International Patent Publication in Japanese (Kohyo) No. 10-500496 disclose use of a filter cartridge containing binding absorption particles and having a first vent for taking up volatilized components and a second vent for discharging them in a heating apparatus for heating a film by contact. Further, WO96/12213 and International Patent Publication in Japanese (Kohyo) No. 10-507403 disclose use of a filter consisting of a combination of heat conductive condensation collector and a gas-absorptive microparticle filter. These can be preferably used in the present invention. Further, U.S. Pat. No. 4,518,845 and JP-B-3-54331 disclose structures comprising means for eliminating vapor from a film, pressing means for pressing a film to a heat-conductive member and means for heating the heat-conductive member. Furthermore, WO98/27458 discloses elimination of components volatilized from a film and increasing fog from a surface of the film. These techniques are also preferably used for the present invention.

Temperature distribution in the preheating section and the heat development section is preferably in the range of ±1° C. or less, more preferably ±0.5° C. or less, respectively.

The photothermographic material heated in the heat development section is then cooled in the gradual cooling section. It is preferred that the cooling should be gradually attained so that the photothermographic material could not physically deform, and the cooling rate is preferably 0.5-1° C./second.

An exemplary structure of heat development apparatus used for the image formation method of the present invention is shown in FIG. 1.

FIG. 1 depicts a schematic side view of a heat development apparatus. The heat development apparatus shown in FIG. 1 consists of a preheating section A for preheating a photothermographic material 10, a heat development section B for carrying out the heat development, and a gradual cooling section C for cooling the photothermographic material. The preheating section A comprises taking-in roller pairs 11 (upper rollers are silicone rubber rollers, and lower rollers are aluminum heating rollers). The Heat development section B is provided with multiple rollers 13 on the side contacting with the surface of the photothermographic material 10 on which the image-forming layer is formed, and a flat surface 14 adhered with non-woven fabric (composed of, for example, aromatic polyamide, Teflon™ etc.) or the like on the opposite side to be contacted with the back layer side surface of the photothermographic material 10. The clearance between the rollers 13 and the flat surface 14 is suitably adjusted to a clearance that allows the transportation of the photothermographic material 10. The clearance is generally about 0-1 mm. In the heat development section B, heaters 15 (panel heaters etc.) are further provided over the rollers 13 and under the flat surface 14 so as to heat the photothermographic material 10 from the image-forming layer side and the back layer side. The gradual cooling section C is provided with taking-out roller pairs 12 for taking out the photothermographic material 10 from the heat development section B and guide panels 16.

The photothermographic material 10 is subjected to heat development while it is transported by the taking-in roller pairs 11 and then by the taking-out roller pairs 12.

After the light exposure, the photothermographic material 10 is carried into the preheating section A. In the preheating section A, the photothermographic material 10 is made into a flat shape, preheated and then transported into the heat development section B by the multiple taking-in rollers 12. The photothermographic material 10 carried into the heat development section B is inserted into the clearance between the multiple rollers 13 and the flat surface 14 and transported by driving of the rollers 13 contacting with the surface 10*a* of the photothermographic material 10, while the back layer side surface 10*b* slides on the flat surface 14. During the transportation, the photothermographic material 10 is heated to a temperature sufficient for the heat development by the heaters 15 from both of the image-forming layer side and the back layer side so that the latent image formed by the light exposure is developed. Then, the photothermographic material 10 it transported into the gradual cooling section C, and made into a flat shape and taken out from the heat development apparatus by the taking-out roller pairs 12.

The materials of the surfaces of the rollers 13 and the member of the flat surface 14 in the heat development section B may be composed of any materials so long as they have heat resistance and they should not cause any troubles in the transportation of the photothermographic material 10. However, the material of surfaces of the rollers 13 is preferably composed of silicone rubber, and the member of the flat surface 14 is preferably composed of non-woven fabric made of aromatic polyamide or Teflon (PTFE). Shape and number of the heaters 15 are not particularly limited so long as they can heat the photothermographic material 10 to a temperature sufficient for the heat development of the material. However, they preferably have such a configuration that heating temperature of each heater can be adjusted freely.

The photothermographic material 10 is heated in the preheating section A comprising the taking-in roller pairs 11 and the heat development section B comprising the heaters 15. Temperature of the preheating section A is preferably controlled to be lower than the heat development temperature (for example, lower by about 10-30° C.), and the temperature and time in this section are desirably adjusted so that they can be sufficient for evaporating solvent contained in the photothermographic material 10. The temperature is also preferably adjusted to be higher than the glass transition temperature (Tg) of the support of the photothermographic material 10 so that uneven development can be prevented. Temperature distribution in the preheating section and the heat development section is preferably in the range of ±1° C. or less, more preferably ±0.5° C. or less.

In the gradual cooling section C, in order to prevent deformation of the photothermographic material 10 due to rapid cooling, the guide panels 16 are preferably composed of a material showing low heat conductivity.

In the image formation method of the present invention, the light exposure and heat development are conducted by an on-line system comprising a plotter, an auto carrier and a heat development apparatus. The auto carrier automatically transports the exposed photothermographic material to the heat development apparatus. Although the transportation mechanism may be based on any of belt conveyor, roller transportation and so forth, roller transportation is preferred. Further, in the auto carrier, there is preferably provided a mechanism for preventing a heat flow from the heat development apparatus side to the plotter side, and for example, a method of blowing a wind to the plotter and the heat development apparatus from a lower position at the center of the auto carrier can be mentioned.

The development is preferably performed with such conditions that the line speed ratio of the preheating section and the heat development section should become 95.0-99.0% and the line speed ratio of the auto carrier and the preheating section should become 90.0-100.0%. If the line speed ratio of the preheating section and the heat development section is less than 95.0% and/or the line speed ratio of the auto carrier and the preheating section is less than 90.0%, scratches or jamming may be caused to degrade the transportability, and it becomes likely that uneven density is unfavorably generated.

As the photothermographic material, for example, one in a form of sheet having a width of 550-650 mm and a length of 1-65 m is used, and it is provided into the heat development system in a state that a part or all of the material is rolled around a core member of cylindrical shape so that the image-forming layer can be exposed to the outside.

EXAMPLES

The present invention will be further specifically explained with reference to the following examples. The materials, amounts, ratios, types of procedure, orders of procedure and so forth shown in the following examples can be optionally changed so long as such change does not depart from the spirit of the present invention. Therefore, the scope of the present invention is not limited by the following examples.

Example 1

1) Preparation of Undercoated Supports

<<Preparation of Polyethylene Terephthalate Supports>>

Polyethylene terephthalate (henceforth abbreviated as "PET") pellets were dried at 130° C. for 4 hours, melted at 300° C., then extruded from a T-die and rapidly cooled to form an unstretched film. The film was stretched along the longitudinal direction by 3.0 times using rollers of different peripheral speeds, and then stretched along the transverse direction by 4.5 times using a tenter. The temperatures used for these operations were 110° C. and 130° C., respectively. Then, the film was subjected to thermal fixation at 240° C. for 20 seconds, and relaxed by 4% along the transverse direction at the same temperature. Thereafter, the film was subjected to a heat treatment by passing it through a zone at 200° C. at a speed of 20 m/min over 10 minutes with a rolling up tension of 3.5 kg/cm$^2$.

Subsequently, the chuck of the tenter was released, the both edges of the film were knurled, and the film was rolled up with a force of 40 N. Thus, a roll of a PET film having a width of 2.4 m, length of 800 m and thickness of 100 μm was obtained. PET film supports having a thickness of 110, 125, 140 or 150 μm were prepared in the same manner as used for the film support having a thickness of 100 μm except that the film thickness was controlled in the unstretched state. All the PET supports showed a glass transition temperature of 79° C.

The both surfaces of the biaxially stretched and thermally fixed PET support having a thickness of 125 μm, which was prepared as described above, was subjected to a corona discharge treatment of 8 W/m$^2$. On one surface of the support, Undercoat coating solution a-1 mentioned below was coated in such an amount that a dry film thickness of 0.8 μm should be obtained and dried to form Undercoat layer A-1, and on the opposite surface, Undercoat coating solution b-1 mentioned below containing an antistatic component was applied in such an amount that a dry film thickness of 0.8 μm should be obtained and dried to form Undercoat layer B-1 having antistatic property.

| <<Undercoat coating solution a-1>> | |
|---|---|
| Copolymer latex solution (solid content: 30%, butyl acrylate/ tert-butyl acrylate/styrene/ 2-hydroxyethyl acrylate = 30/20/25/25 (weight %)) | 270.0 g |
| (C-1) | 0.6 g |
| Hexamethylene-1,6-bis(ethyleneurea) | 0.8 g |
| Polystyrene microparticles (mean particle size: 3 μm) | 0.05 g |
| Colloidal silica (mean particle size: 90 μm) | 0.1 g |
| Water | Make to a total volume of 1000 mL |

| <<Undercoat coating solution b-1>> | |
|---|---|
| $SnO_2$/Sb (weight ratio: 9/1, mean particle size: 0.18 μm) | Amount giving coating amount of 200 mg/m$^2$ |
| Copolymer latex solution (solid content: 30%, butyl acrylate/ styrene/glycidyl acrylate = 30/20/40 (weight %) | 270.0 g |
| (C-1) | 0.6 g |
| Hexamethylene-1,6-bis(ethyleneurea) | 0.8 g |
| Water | Make to a total volume of 1000 mL |

The upper surfaces of Undercoat layer A-1 and Undercoat layer B-1 were subjected to a corona discharge treatment of 8 W/m$^2$. On Undercoat layer A-1, Upper undercoat coating solution a-2 mentioned below was coated in such an amount that a dry film thickness of 0.1 μm should be obtained to form Upper undercoat layer A-2, and on Undercoat layer B-1, Upper undercoat coating solution b-2 mentioned below was applied in such an amount that a dry film thickness of 0.8 μm should be obtained to form Upper undercoat layer B-2 having antistatic property.

| <<Upper undercoat coating solution a-2>> | |
|---|---|
| Gelatin | Amount giving coated amount of 0.4 g/m$^2$ |
| (C-1) | 0.2 g |
| (C-2) | 0.2 g |
| (C-3) | 0.1 g |
| Silica particles (mean particle size: 3 μm) | 0.1 g |
| Water | Make to a total volume of 1000 mL |

| <<Upper undercoat coating solution b-2>> | |
|---|---|
| (C-4) | 60 g |
| Latex solution containing (C-5) (solid content: 20%) | 80 g |
| Ammonium sulfate | 0.5 g |
| (C-6) | 12 g |
| Polyethylene glycol (weight average molecular weight: 600) | 6 g |
| Water | Make to a total volume of 1000 mL |

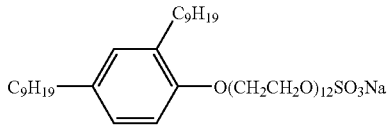

(C-1)

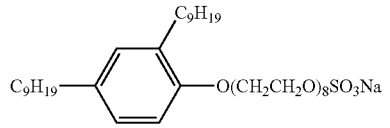

(C-2)

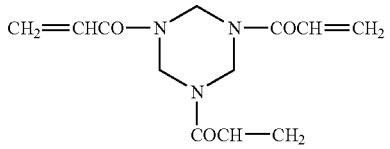

(C-3)

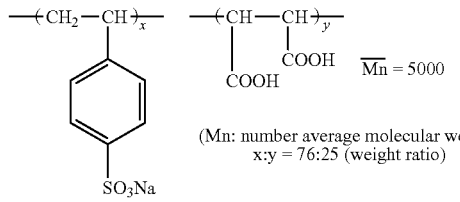

(Mn: number average molecular weight)
x:y = 76:25 (weight ratio)

(C-4)

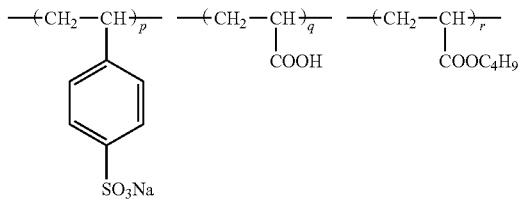

p:q:r:s:t = 40:5:10:5:40 (weight ratio)

(C-5)

-continued

<<Upper undercoat coating solution b-2>>

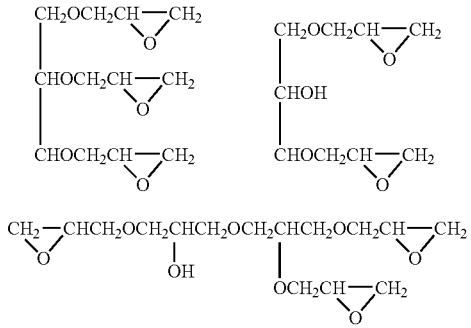

(C-6)

Mixture of three kinds of compounds

<Heat Treatment of Support>>

The aforementioned undercoated support was heated to 150° C. during the drying process for undercoat layers and then gradually cooled. The rolling up tension was 3.6 kg/cm$^2$.

2) Preparation of Emulsions and Solutions

<<Preparation of Silver Halide Emulsion>>

In an amount of 7.5 g of inert gelatin and 10 mg of potassium bromide were dissolved in 900 mL of water, and the solution was adjusted to a temperature of 35° C. and pH 3.0, and added with 370 mL of an aqueous solution containing 74 g of silver nitrate and 370 mL of an aqueous solution containing sodium chloride, potassium bromide, potassium iodide in a molar ratio of 60/38/2, $[Ir(NO)Cl_5]$ salt in an amount of $1\times10^{-6}$ mole per mole of silver and rhodium chloride salt in an amount of $1\times10^{-6}$ mole per mole of silver by the controlled double jet method, while the pAg was kept at 7.7. Then, the solution was added with 4-hydroxy-6-methyl-1,3,3a,7-tetrazaindene and adjusted to pH 8.0 with NaOH and pAg 6.5 to perform reduction sensitization. Thus, cubic silver iodobromide grains having a mean grain size of 0.06 μm, monodispersion degree of 10%, variation coefficient of 8% for diameter of projected area as circle and [100] face ratio of 87%. This emulsion was added with a gelatin coagulant to cause coagulation precipitation for desalting, then added with 0.1 g of phenoxyethanol and adjusted to pH 5.9 and pAg 7.5 to obtain a silver halide emulsion.

<<Preparation of Sodium Behenate Solution>>

In an amount of 32.4 g of behenic acid, 9.9 g of arachidic acid and 5.6 g of stearic acid were dissolved in 945 mL of pure water at 90° C. Then, the solution was added with 98 mL of 1.5 mol/L sodium hydroxide aqueous solution with stirring at high speed. Subsequently, the solution was added with 0.93 mL of concentrated nitric acid, cooled to 55° C. and stirred for 30 minutes to obtain a sodium behenate solution.

<<Preparation of Preform Emulsion of Silver Behenate and Silver Halide Emulsion>>

The aforementioned sodium behenate solution was added with the silver halide emulsion mentioned above, adjusted to pH 8.1 with a sodium hydroxide solution, then added with 147 mL of 1 mol/L silver nitrate solution over 7 minutes, and stirred for 20 minutes, and water-soluble salts were removed by ultrafiltration. The produced silver behenate was in the form of grains having a mean grain size of 0.8 μm and monodispersion degree of 8%. After flocculates of the dispersion was formed, water was removed and the residue was subjected to 6 times of washing with water and removal of water and dried to obtain a preform emulsion.

<<Preparation of Photosensitive Emulsion>

The aforementioned preform emulsion was divided into portions and gradually added with 544 g of a solution of polyvinyl butyral (average molecular weight: 3,000) in methyl ethyl ketone (17 weight %) and 107 g of toluene, mixed and then dispersed at 30° C. for 10 minutes in a media dispersing machine utilizing a bead mill containing $ZrO_2$ having a size of 0.5 mm at 4000 psi to prepare a photosensitive emulsion. After the dispersion, the organic silver grains were examined by electron microphotography. As a result of measurement of grain size and thickness of 300 organic silver grains, it was found that 205 or more of the grains were monodispersed tabular organic silver grains having AR of 3 or more and dispersion degree of 25%. The mean grain size was 0.7 μm. Moreover, the organic silver grains were examined also after coating and drying, and the same grains could be confirmed.

The both surfaces of the aforementioned support were simultaneously coated with the following layers to prepare Sample 1. Each layer was dried at 60° C. for 15 minutes.

3) Coating of Back Surface Side

A solution having the following composition was applied on Undercoat layer B-2 of the support.

| <<Coating solution for back layer>> | |
|---|---|
| Cellulose acetate butyrate (10% solution in methyl ethyl ketone) | 15 mL/m$^2$ |
| Dye A | 60 mg/m$^2$ |
| Matting agent (monodispersed silica, monodispersion degree: 15%, mean particle size: 8 μm) | 85 mg/m$^2$ |
| $C_8F_{17}(CH_2CH_2O)_{12}C_8F_{17}$ | 50 mg/m$^2$ |
| $C_9F_{19}$—$C_6H_4$—$SO_3Na$ | 10 mg/m$^2$ |

4) Coating of Image-Forming Layer Surface Side

A solution having the following composition was coated on Undercoat layer A-2 of the support in such an amount that the coated silver amount should become 1.5 g/m$^2$ and dried to form an image-forming layer.

| <<Coating solution for image-forming layer | |
|---|---|
| Photosensitive emulsion mentioned above | 240 g |
| Sensitizing dye (0.1% methanol solution) | 1.7 mL |
| Pyridinium perbromide (6% methanol solution) | 3 mL |
| Calcium bromide (0.1% methanol solution) | 1.7 mL |
| Oxidizing agent (10% methanol solution) | 1.2 mL |
| Antifoggant | 1.0 g |
| 2-Mercaptobenzimidazole (1% methanol solution) | 11 mL |
| Ttribromomethylsulfoquinoline (5% methanol solution) | 8 mL |
| Ttribromomethylsulfopyridine | 9 mL |

-continued

| <<Coating solution for image-forming layer | |
|---|---|
| (5% methanol solution) | |
| High contrast agent | 0.4 g |
| Hydrazine 1 | 0.3 g |
| Phthalazine | 0.6 g |
| 4-Methylphthalic acid | 0.25 g |
| Tetrachlorophthalic acid | 0.2 g |
| Calcium carbonate (mean particle size: 3 μm) | 0.1 g |
| 1,1-Bis(2-hydroxy-3,5-dimethylphenyl)- | 5.0 mL |

-continued

| <<Coating solution for image-forming layer | |
|---|---|
| 2-methylpropane (20% methanol solution) | |
| 1,1-Bis(2-hydroxy-3,5-dimethylphenyl)-3,5,5-trimethylhexane (20% methanol solution) | 16.0 mL |

A solution having the following composition was coated at the same time as the coating of the image-forming layer on the image-forming layer to form a surface protective layer.

| <<Coating solution for surface protective layer>> | |
|---|---|
| Acetone | 5 mL/m$^2$ |
| Methyl ethyl ketone | 21 mL/m$^2$ |
| Cellulose acetate butyrate | 2.3 g/m$^2$ |
| Methanol | 7 mL/m$^2$ |
| Phthalazine | 250 mg/m$^2$ |
| Matting agent (monodispersed silica, monodispersion degree: 10%, mean grain size: 4 μm) | 7 mg/m$^2$ |
| $CH_2{=}CHSO_2CH_2CONHCH_2CH_2NHCOCH_2SO_2CH{=}CH_2$ | 35 mg/m$^2$ |
| Fluorine -containing surfactants | |
| $C_{12}F_{25}(CH_2CH_2O)_{10}C_{12}F_{25}$ | 10 mg/m$^2$ |
| $C_8F_{17}{-}C_6H_4{-}SO_3Na$ | 10 mg/m$^2$ |

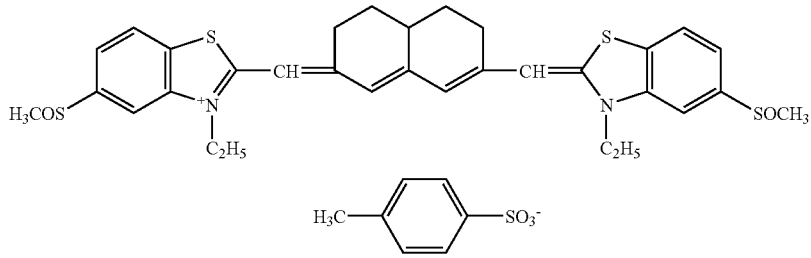

Sensitizing dye

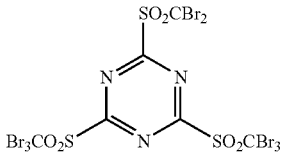

Oxidizing agent

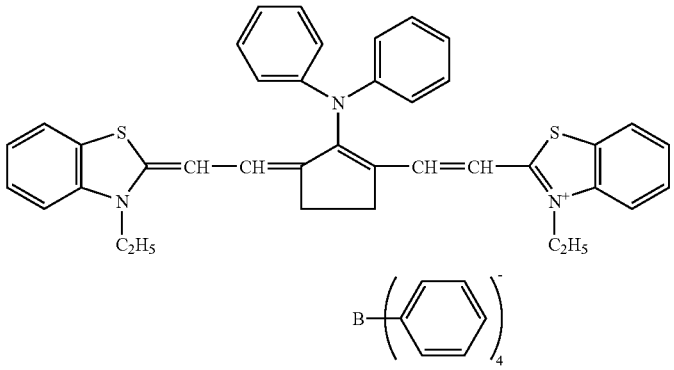

Dye A

-continued

<<Coating solution for surface protective layer>>

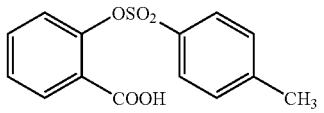

Antifoggant

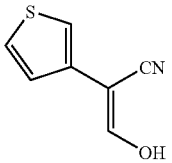

High contrast agent

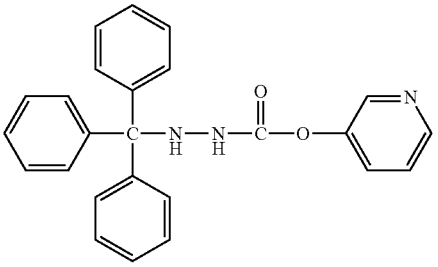

Hydrazine 1

5) Preparation of Various Photothermographic Materials

A photothermographic material as Sample 1 was obtained as described above.

A photothermographic material as Sample 2 was also prepared in the same manner as that for Sample 1 except that 0.5 g of an isocyanate compound (Desmodur N3300) was added to the coating solution for image-forming layer.

Further, photothermographic materials of Samples 3 to 9 were prepared in the same manner as that for Sample 2 except that the amount of cellulose acetate butyrate was controlled so that each dry film thickness mentioned in Table 1 could be obtained and an aziridine compound, epoxy compound or carbodiimide compound according to the present invention was added in each amount mentioned in Table 1.

Furthermore, photothermographic materials of Samples 10 to 13 were prepared in the same manner as that for Sample 4 except that the thickness of the support was changed to 100, 110, 140 and 150 μm.

6) Light Exposure

Each of the obtained photothermographic materials was light exposed for $1.2\times10^{-8}$ second (main scanning speed: 1047 m/second) at a mirror revolution number of 60000 rpm by using a laser plotter of single channel cylindrical internal surface scanning type provided with a semiconductor laser with a beam diameter (½ of FWHM of beam intensity) of 12.56 μm, laser output of 50 mW and output wavelength of 780 nm. The overlap coefficient of the light exposure was 0.449, and the laser energy density on the photothermographic material surface was 75 $\mu J/cm^2$.

7) Heat Development

Each photothermographic material was transported from the plotter by an auto carrier to such a heat development apparatus as shown in FIG. 1 and heat-developed therein in an on-line manner. The roller surface material of the heat development section was composed of silicone rubber, and the flat surface consisted of Teflon non-woven fabric. The transportation line speed in the heat development section was 25 mm/second. The heat development was performed for 12.2 seconds in the preheating section (driving units of the preheating section and the heat development section were independent from each other, and speed difference as to the heat development section was adjusted to −0.5% to −1%, temperatures of each of the metallic rollers and processing times in the preheating section were as follows: first roller, 67° C. for 2.0 seconds; second roller, 82° C. for 2.0 seconds; third roller, 98° C. for 2.0 seconds; fourth roller, 107° C. for 2.0 seconds; fifth roller, 115° C. for 2.0 seconds; and sixth roller, 120° C. for 2.0 seconds), for 17.2 seconds at 12° C. (surface temperature of photothermographic material) in the heat development section, and for 13.6 seconds in the gradual cooling section. The temperature precision as for the transverse direction was ±0.5° C. As for temperature setting of each roller, the temperature precision was secured by using a length of rollers longer than the width of the photothermographic material (for example, width of 61 cm) by 5 cm for the both sides and also heating the protruding portions. Since the rollers showed marked temperature decrease at the both end portions, the temperature of the portions protruding by 5 cm from the ends of the photothermographic material was controlled to be higher than that of the roller center by 1-3° C., so that uniform image density of finished developed image could be obtained for the whole photothermographic material (for example, within a width of 61 cm).

For comparison, a similar test was also performed by using a heat development apparatus that was modified so that the samples could be heat-developed by heating them as course of events without temperature control of the preheating section and then the samples should pass through the cooling section over 6 seconds (without preheating and gradual cooling).

8) Evaluation

<<Evaluation of Photographic Performance (Sensitivity)>>

Sensitivity of each sample exposed and heat-developed as described above was evaluated (reciprocal of a ratio of exposure giving an optical density higher than Dmin (fog) by 1.5). The sensitivity was represented with a relative value based on the sensitivity of Sample 1, of which sensitivity was taken as 100.

<<Evaluation of Film Strength Before and after Heat Development>

For each sample uniformly exposed, load continuously increasing from 0 g to 200 g was applied through a sapphire needle having a tip end curvature radius of 0.1 mm on an image-forming layer side surface, and a load at which a scratch began to be generated (scratch strength) was determined before and after the heat development by using a scratch meter HEIDON Model 18L manufactured by Shinto Kagaku Co., Ltd.

<<Evaluation of Surface Abrasions>>

Each sample uniformly exposed was subjected to the heat development described above, and then number of abrasions having a length of 0.5 mm or more was counted in an area of the A2 size (420 mm×594 mm) on the image-forming layer side. The number was evaluated according to the criteria described below.

A: No abrasion was observed.

B: Although one or two abrasions were observed, there is no problem for practical use.

C: Although three to five abrasions were observed, there is no problem for practical use.

D: Six to ten abrasions were observed, and they constitute a slight obstacle for practical use.

E: Eleven or more abrasions were observed, and they constitute a serious obstacle for practical use.

In the evaluation, the grades of A to C were determined to be acceptable for practical use.

<Evaluation of Image Defect and Printing Blur>>

Each sample uniformly exposed was subjected to the heat development described above, and then image was printed on a PS plate (A2 size) by using an automatic platemaking machine, S—FNRIII, produced by Fuji Photo Film Co., Ltd. State of image defect generation or printing blur generation due to abrasions or cutting chips was evaluated by visual inspection according to the following criteria including three grades.

○: No image defect and no printing blur were observed.

Δ: Image defects and printing blurs were slightly generated.

X: Image defects and printing blurs were markedly generated.

<<Evaluation of Surface Unevenness after Heat Development>>

Each sample uniformly exposed was subjected to the heat development described above, and then surface unevenness on the image-forming layer side was evaluated by visual inspection according to the following criteria including three grades.

○: Surface was completely smooth, and no unevenness was observed.

Δ: surface unevenness was slightly generated.

X: Surface unevenness was generated for the whole surface.

9) Results

The results of the evaluations are shown Table 1.

TABLE 1

| | Structure | | | | | Processing | | |
|---|---|---|---|---|---|---|---|---|
| | Presence or absence | Species of compound | | Thickness | Thickness of | Presence or absence of preheating | Evaluation Scratch strength (g) | |
| Sample No. | of isocyanate | Compound | Amount (mole/m$^2$) | of support (μm) | protective layer (μm) | and gradual cooling | Before heat development | After heat development |
| 1 | Not used | — | — | 125 | 2.3 | Used | 53 | 47 |
| 2 | Used | — | — | 125 | 2.3 | Used | 88 | 175 |
| 3 | Used | — | — | 125 | 1.5 | Used | 69 | 67 |
| 4 | Used | — | — | 125 | 2.7 | Used | 104 | 214 |
| 5 | Used | AZ-1 | $3.2 \times 10^{-3}$ | 125 | 2.7 | Used | 118 | 268 |
| 6 | Used | AZ-1 | $3.2 \times 10^{-3}$ | 125 | 4.7 | Used | 157 | 189 |
| 7 | Used | AZ-1 | $3.2 \times 10^{-3}$ | 125 | 5.4 | Used | 174 | 170 |
| 8 | Used | EP-1 | $3.2 \times 10^{-3}$ | 125 | 2.7 | Used | 122 | 287 |
| 9 | Used | *1 | $3.2 \times 10^{-3}$ | 125 | 2.7 | Used | 119 | 276 |
| 10 | Used | — | — | 100 | 2.7 | Used | 100 | 219 |
| 11 | Used | — | — | 110 | 2.7 | Used | 102 | 211 |
| 12 | Used | — | — | 140 | 2.7 | Used | 101 | 210 |
| 13 | Used | — | — | 150 | 2.7 | Used | 102 | 212 |
| 2 | Used | — | — | 125 | 2.7 | Not used | 102 | 99 |
| 5 | Used | AZ-1 | $3.2 \times 10^{-3}$ | 125 | 2.7 | Not used | 120 | 114 |

TABLE 1-continued

| | Evaluation | | | | | |
|---|---|---|---|---|---|---|
| Sample No. | Scratch strength ratio | Abrasion | Image defect and printing blur | Surface unevenness | Relative sensitivity | Note |
| 1 | 1:0.89 | E | X | ○ | 100 | Comparative |
| 2 | 1:2.0 | B | ○ | ○ | 100 | Invention |
| 3 | 1:0.97 | D | X | ○ | 104 | Comparative |
| 4 | 1:2.1 | A | ○ | ○ | 100 | Invention |
| 5 | 1:2.3 | A | ○ | ○ | 99 | Invention |
| 6 | 1:1.3 | B | ○ | ○ | 96 | Invention |
| 7 | 1:0.98 | B | ○ | ○ | 88 | Comparative |
| 8 | 1:2.4 | A | ○ | ○ | 98 | Invention |
| 9 | 1:2.3 | A | ○ | ○ | 100 | Invention |
| 10 | 1:2.2 | A | ○ | Δ | 100 | Invention |
| 11 | 1:2.1 | A | ○ | ○ | 100 | Invention |
| 12 | 1:2.1 | A | ○ | ○ | 100 | Invention |
| 13 | 1:2.1 | A | Δ | ○ | 100 | Invention |
| 2 | 1:0.97 | C | ○ | X | 79 | Comparative |
| 5 | 1:0.95 | C | ○ | X | 85 | Comparative |

*1: N,N'-Di(4-dipropylaminotolyl)carbodiimide

As clearly seen from the results shown in Table 1, it was found that the photothermographic materials of the present invention had a high scratch strength after the heat development, scarcely generated abrasions and surface unevenness during the heat treatment and scarcely generated image defects or printing blurs on PS plates, and thus they had good properties for the subsequent processing. Further, it was also found that the support thickness range of 110-140 μm was more preferred, since generations of image defects and surface unevenness were completely eliminated with a support having a thickness within the range.

Example 2

Photothermographic materials were prepared in the same manner as in Example 1 except that the silver halide was subjected to chemical sensitization. As for the method of chemical sensitization, the silver halide emulsion was warmed to 60° C., added with thiourea dioxide, 2,3,4,5,6-pentafluorophenylphosphine selenide and chloroauric acid in amounts of $5\times10^{-5}$ mole/Ag mole, $1\times10^{-5}$ mole/Ag mole and $8\times10^{-6}$ mole/Ag mole, respectively, ripened for 50 minutes, and then rapidly cooled to 35° C. for completion of the chemical sensitization to prepare a silver halide emulsion. As a result of evaluations similar to those of Example 1, results similar to those of Example 1 were obtained. Thus, the advantages of the present invention were clearly demonstrated.

Example 3

The samples used in Examples 1 and 2 were exposed and heat-developed by using an A2 size plotter, FT-286R, produced by NEC Corp., a dry film processor, FDS-6100X, produced by Fuji Photo Film Co., Ltd., and a dry system auto carrier, FDS-C1000, produced by Fuji Photo Film Co., Ltd., and similarly evaluated. As a result, results similar to those of Examples 1 and 2 were obtained. Thus, the advantages of the present invention were clearly demonstrated.

Example 4

The procedure of Example 3 was repeated by using an A1/A2 size plotter, FT-296R, produced by NEC Corp. and a dry system auto carrier, FDS-C1100, produced by Fuji Photo Film Co., Ltd. were used for the light exposure and heat development instead of the A2 size plotter, FT-286R, produced by NEC Corp. and the dry system auto carrier, FDS-C1000, produced by Fuji Photo Film Co., Ltd, and similar evaluations were performed. As a result, results similar to those of Examples 1 and 2 were obtained. Thus, the advantages of the present invention were clearly demonstrated.

Example 5

The procedures of Examples 1 to 4 were repeated by changing the processing speed in the heat development section from 25 mm/second to 28 mm/second, and similar evaluations were performed. As a result, results similar to those of Examples 1 to 4 were obtained. Thus, the advantages of the present invention were clearly demonstrated.

Example 6

The procedures of Examples 1 to 5 were repeated by changing the main scanning speed on the photothermographic material surface in the plotter from 1047 mm/second to 1360 mm/second, and similar evaluations were performed. As a result, results similar to those of Examples 1 to 5 were obtained. Thus, the advantages of the present invention were clearly demonstrated.

What is claimed is:

1. A method for forming an image, which comprises developing a photothermographic material comprising a non-photosensitive layer having a thickness of from 2.0 to 2.7 μm and an image-forming layer containing a silver salt of an organic acid, photosensitive silver halide grains and a reducing agent on a support wherein:

said non-photosensitive layer is a protective layer formed on the image-forming layer, and at least one of the non-photosensitive layer and the image-forming layer contains at least one hardening agent, in a heat development apparatus provided with a preheating section, a heat development section and gradual cooling section so that the ratio of scratch strength of the protective layer measured before the treatment in the heat development apparatus and scratch strength of the protective layer measured 30 minutes after the treatment in the heat development apparatus can be in the range of 1:1 to 1:3 for a surface of the image-forming layer side, wherein said scratch strength is measured by a sapphire needle having a tip end curvature radius of 0.1 mm, wherein said heat development apparatus is further provided with a deodorizing apparatus and said photothermographic material is exposed and developed with an on-line system comprising an auto carrier capable of automatically transporting the photothermographic material from a plotter to the heat development apparatus, wherein a light source for light exposure of the plotter is a laser of a wavelength of 750-800 nm, and main scanning speed on a surface of the photothermographic material is 500-1500 m/second.

2. The method of forming an image according to claim 1, wherein the ratio of scratch strength measured before heat development and scratch strength measured 30 minutes after the heat development is in the range of 1:2-1:3.

3. The method of forming an image according to claim 1, wherein the scratch strength measured before heat development is 80-300 g.

4. The method of forming an image according to claim 1, wherein the scratch strength measured before heat development is 100-300 g.

5. The method of forming an image according to claim 1, wherein the non-photosensitive layer contains an inorganic matting agent.

6. The method of forming an image according to claim 1, wherein the transparent support was subjected to a heat treatment.

7. The method of forming an image according to claim 1, wherein the transparent support has a thickness of 110-140 μm.

8. The method of forming an image according to claim 1, wherein the transparent support has a thickness of 110-125 μm.

9. The method of forming an image according to claim 1, which contains a high contrast agent.

10. The method of forming an image according to claim 1, wherein at least one layer formed on the image-forming layer side contains an aziridine compound.

11. The method of forming an image according to claim 1, wherein at least one layer formed on the image-forming layer side contains an epoxy compound.

12. The method of forming an image according to claim 1, wherein at least one layer formed on the image-forming layer side contains a carbodiimide compound.

13. The method for forming an image according to claim 1, wherein processing speed of the auto carrier ($t_1$), processing speed of the pre-heating section of the heat development apparatus ($t_2$) and processing speed of the heat development section of the heat development apparatus ($t_3$) satisfy the following relationship:

$$t_3 > t_2 \geqq t_1.$$

14. The method for forming an image according to claim 1, wherein the processing speed of the photothermographic material in the heat development section is 21-100 mm/second.

15. The method for forming an image according to claim 1, wherein the processing speed of the photothermographic material in the heat development section is 27-50 mm/second.

16. The method for forming an image according to claim 1, wherein the main scanning speed on a surface of the photothermographic material is 1100-1500 m/second.

17. The method for forming an image according to claim 1, wherein the hardening agent is an isocyanate.

18. The method for forming an image according to claim 1, wherein the image forming layer contains isocyanate in combination with an aziridine compound, an epoxy compound or a carbodiimide compound.

19. The method for forming an image according to claim 1, wherein gradual cooling is conducted after the thermal development.

20. The method for forming an image according to claim 17, wherein gradual cooling is conducted after the thermal development.

21. The method for forming an image according to claim 18, wherein gradual cooling is conducted after the thermal development.

22. The method for forming an image according to claim 1, wherein the heat development section has an temperature of 110 to 140° C.

23. The method for forming an image according to claim 22, wherein the treatment in the heat development apparatus is carried out within the time range of 5 to 180 seconds.

* * * * *